US007836611B2

(12) United States Patent
Sellers et al.

(10) Patent No.: US 7,836,611 B2
(45) Date of Patent: Nov. 23, 2010

(54) SKI BOOT ATTACHMENT

(75) Inventors: David R. Sellers, 3305 County Road 96, Ward, CO (US) 80481; Ravi K. Sawhney, Calabasas, CA (US); Kurt Botsai, Thousand Oaks, CA (US); Robb Englin, Los Angeles, CA (US); Simon Risley, Ventura, CA (US); John Vernon, Malibu, CA (US)

(73) Assignee: David R. Sellers, Ward, CO (US)

( * ) Notice: Subject to any disclaimer, the term of this patent is extended or adjusted under 35 U.S.C. 154(b) by 1077 days.

(21) Appl. No.: 11/546,614

(22) Filed: Oct. 12, 2006

(65) Prior Publication Data

US 2007/0079531 A1 Apr. 12, 2007

Related U.S. Application Data

(63) Continuation-in-part of application No. 11/259,816, filed on Oct. 26, 2005, now Pat. No. 7,637,037, and a continuation-in-part of application No. 11/189,204, filed on Jul. 25, 2005, now Pat. No. 7,637,036.

(60) Provisional application No. 60/659,991, filed on Mar. 7, 2005.

(51) Int. Cl.
*A43B 13/00* (2006.01)
*A43C 13/02* (2006.01)

(52) U.S. Cl. ..... 36/103; 36/15; 36/132; 36/117.4

(58) Field of Classification Search ..... 36/7.5, 36/7.6, 117.4, 117.3, 132, 135, 37, 103, 123, 36/106, 97; D2/914
See application file for complete search history.

(56) References Cited

U.S. PATENT DOCUMENTS

| | | | |
|---|---|---|---|
| 3,964,761 | A | 6/1976 | Syrovatka |
| 3,965,586 | A | 6/1976 | Roosli |
| 3,971,144 | A | 7/1976 | Brugger-Stuker |
| 4,123,854 | A | 11/1978 | Pasich |
| D250,796 | S | 1/1979 | DeFever |
| 4,156,316 | A | 5/1979 | DeFever |
| 4,199,880 | A | 4/1980 | Frey |

(Continued)

*Primary Examiner*—Jila M Mohandesi
(74) *Attorney, Agent, or Firm*—Daniel P. Dooley; Fellers, Snider, et al.

(57) ABSTRACT

A combination that preferably includes at least a main body portion, a heel portion hinged to the main body portion, and a toe portion in sliding engagement with the main body portion, which collectively forms a ski boot attachment by steps for assembling a ski boot attachment is disclosed. The ski boot attachment preferably assembled by steps that include at least installing a spring mount within a component cavity of a main chassis, positioning a release spring within the component cavity, placing an extension control member within the component cavity in abutting contact with the release spring, compressing the release spring with the extension control member, sliding a slide member into the component cavity into sliding contact with the extension control member, attaching a main spring to the spring mount and the slide member, and securing a chassis cover to the main chassis.

6 Claims, 21 Drawing Sheets

U.S. PATENT DOCUMENTS

| | | | | |
|---|---|---|---|---|
| 4,228,602 | A | 10/1980 | Groves | |
| 4,269,430 | A | 5/1981 | Eie | |
| 4,286,397 | A | 9/1981 | Booty | |
| 4,291,473 | A | 9/1981 | Sartor | |
| D263,516 | S | 3/1982 | Booty | |
| 4,403,789 | A | 9/1983 | Hickey | |
| 4,461,104 | A | 7/1984 | Calkin et al. | |
| D277,899 | S | 3/1985 | Hutchinson | |
| 4,505,057 | A | 3/1985 | Kiester | |
| 4,542,599 | A | 9/1985 | Annovi | |
| 4,727,662 | A | 3/1988 | Ilon | |
| 4,774,775 | A | 10/1988 | Pruitt | |
| 4,843,672 | A | 7/1989 | Fasse | |
| 4,958,445 | A | 9/1990 | Brisco | |
| 5,569,173 | A | 10/1996 | Varn | |
| 5,746,016 | A | 5/1998 | Freisinger et al. | |
| 5,815,953 | A | 10/1998 | Kaufman et al. | |
| 5,891,067 | A | 4/1999 | Reed | |
| 5,961,477 | A | 10/1999 | Turtzo | |
| 6,044,578 | A | 4/2000 | Kelz | |
| 6,276,697 | B1 * | 8/2001 | Lin | 280/11.26 |
| 6,277,087 | B1 | 8/2001 | Hess et al. | |
| 6,301,804 | B1 | 10/2001 | Battaglia | |
| 6,361,514 | B1 | 3/2002 | Brown et al. | |
| 6,421,935 | B1 | 7/2002 | Bartlett | |
| 6,450,510 | B1 * | 9/2002 | Liu | 280/11.26 |
| 6,481,121 | B1 | 11/2002 | Tucker | |
| 6,523,280 | B1 | 2/2003 | Lapointe | |
| 6,612,592 | B1 * | 9/2003 | Soo | 280/11.16 |
| 6,883,812 | B1 * | 4/2005 | Hsieh | 280/11.231 |
| 6,916,027 | B2 * | 7/2005 | Chen | 280/11.26 |
| 6,918,602 | B2 * | 7/2005 | Lu | 280/11.26 |
| 2002/0189133 | A1 | 12/2002 | Parisotto et al. | |
| 2004/0094917 | A1 * | 5/2004 | Frigo et al. | 280/11.31 |

* cited by examiner

SKI BOOT ATTACHMENT

RELATED APPLICATIONS

This application is a continuation-in-part of U.S. Pat. Continuation-In-Part application Ser. No. 11/259,816 filed Oct. 26, 2005, entitled DETACHABLE SOLE FOR AN ANKLE AND FOOT COVERING, which claims priority to U.S. patent application Ser. No. 11/189,204 entitled DETACHABLE SOLE FOR AN ANKLE AND FOOT COVERING filed Jul. 25, 2005, which claims priority to U.S. Provisional Application No. 60/659,991 filed Mar. 7, 2005, entitled SKI BOOT ATTACHMENTS.

FIELD OF THE INVENTION

This invention relates to detachable soles for ankle and foot coverings, which afford easier walking for individuals wearing ankle and foot coverings, and more particularly, but not by way of limitation, to attachments that easily attach and detach to the bottoms of ski boots.

BACKGROUND

Walking in orthopedic devices or ski boots is an awkward endeavor at best. Attachments that fit onto the bottom of ski boots and orthopedic devices have been proposed in the prior art. However, each proposed solution has drawbacks, which fail to provide: an overall solution to ease the process of walking in ski boots or orthopedic devices when encountering changes in the walking terrain; and a convenient, compact configuration for storing the attachment when not in use.

As such, challenges remain and a need persists for improvements in methods and apparatuses for use in enhancing the walking experience of individuals wearing ski boots or orthopedic devices.

BRIEF SUMMARY OF THE INVENTION

In accordance with preferred embodiments, a combination including a main body portion, a heel portion hinged to the main body portion, and a toe portion in sliding engagement with the main body portion, which collectively forms a ski boot attachment by steps for assembling a ski boot attachment is provided.

In a preferred embodiment, the main body portion includes at least a main chassis providing a component cavity, a spring mount nested within the component cavity and constrained by the main chassis, and an extension control member in sliding communication with a main chassis and nested within the component cavity. The main body portion further preferably includes a component's cavity cover enclosing the component cavity, and a main track attached to a bottom portion of the main chassis.

Preferably, the heel portion provides a heel chassis that includes a main hinge plate reception cavity, a main hinge plate nested within the main hinge plate reception cavity, a main hinge pin engaging the heel chassis and securing the hinge plate to the heel chassis, and a heel tread attached to a bottom portion of the heel chassis. While the toe portion preferably includes a toe chassis that provides a toe hinge plate reception cavity, a toe hinge plate nested in the toe hinge plate reception cavity, and a toe hinge pin engaging the toe chassis and securing the toe hinge plate to the toe chassis. As with the main body portion and the heel portions, the toe portion preferably includes a toe tread attached to a bottom portion of the heel chassis.

The toe portion further preferably includes a slide member hinged to the toe chassis. The slide member regulates an overall length of the apparatus and includes at least a slide chassis providing a spring channel, a toe hinge plate reception cavity provided by the slide chassis for receipt of the toe hinge plate, a hinge pin aperture provided by the slide chassis and communicating with the toe hinge plate reception cavity provided by the slide chassis, a second toe hinge pin engaging the hinge pin aperture provided by the slide chassis and securing the toe hinge pin plate to the slide chassis, a spring stay disposed within the spring channel and attached to a slide chassis, and a slide tread attached to a bottom portion of the slide chassis.

In an alternate preferred embodiment, the ski boot attachment preferably assembled by steps that include at least installing a spring mount within a component cavity of a main chassis, positioning a release spring within the component cavity, placing an extension control member within the component cavity in abutting contact with the release spring, compressing the release spring with the extension control member, sliding a slide member into the component cavity into sliding contact with the extension control member, attaching a main spring to the spring mount and the slide member, and securing a chassis cover to the main chassis.

These and various other features and advantages that characterize the claimed invention will be apparent upon reading the following detailed description and upon review of the associated drawings.

DETAILED DESCRIPTION

Reference will now be made in detail to one or more examples of the invention depicted in the figures. Each example is provided by way of explanation of the invention, and not meant as a limitation of the invention. For example, features illustrated or described as part of one embodiment may be used with another embodiment to yield still a different embodiment. Other modifications and variations to the described embodiments are also contemplated within the scope and spirit of the invention.

Figure 1:
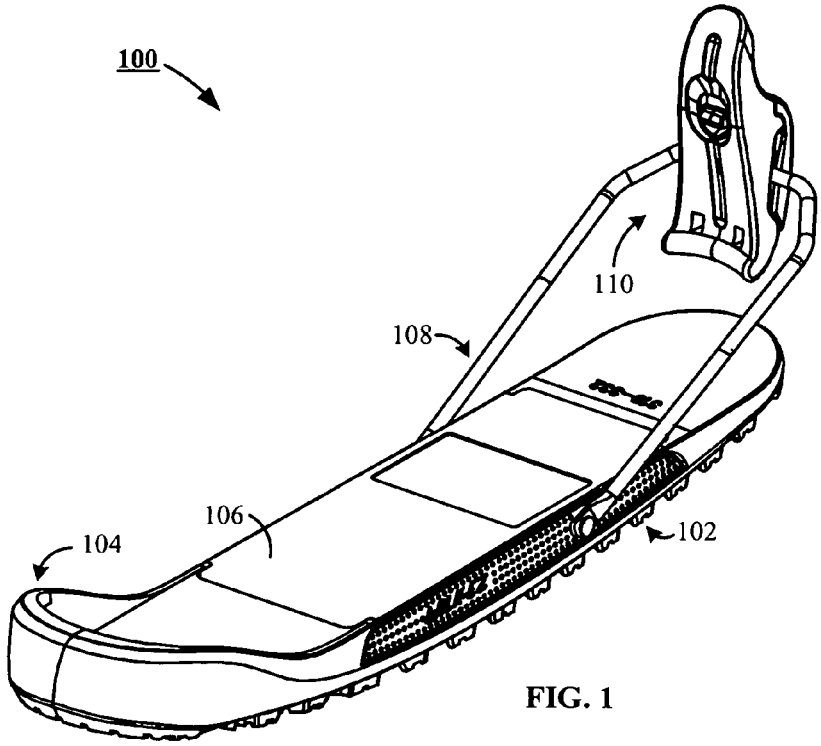
FIG. 1 shows a top perspective view of an embodiment of an inventive detachable sole.

Referring to the drawings, FIG. 1 shows an inventive detachable sole 100 that includes a tread portion 102, which includes a toe confinement portion 104, attached to a chassis 106. In a preferred embodiment, the tread portion 102 is attached to the chassis 106 through the use of an overmold process. However, alternate techniques may be used for the attachment of the tread portion 102 to the chassis 106, such as through the employment of adhesive material, or by sonically welding the components together.

In a preferred embodiment, the chassis 106 is formed from glass filled polypropylene compound, in which the compound contains between 10-30% glass by volume, and preferably 20% glass by volume, and the tread portion 102 is preferably formed from a quasi pliable polymer such as the thermoplastic elastimer resin (TPE), or a polyurethane.

FIG. 1 further shows the inventive detachable sole 100 further includes an attachment hoop 108, which is preferably formed from nickel plated steel, but may be formed from alternate materials such as a carbon filed compound, or stainless steel. In a preferred embodiment, the attachment hoop 108 supports a latch 110, that is preferably an over-center latch. The latch 110 accommodates attachment of the detachable sole 100 to a plurality of ankle and foot coverings.

Figure 2:
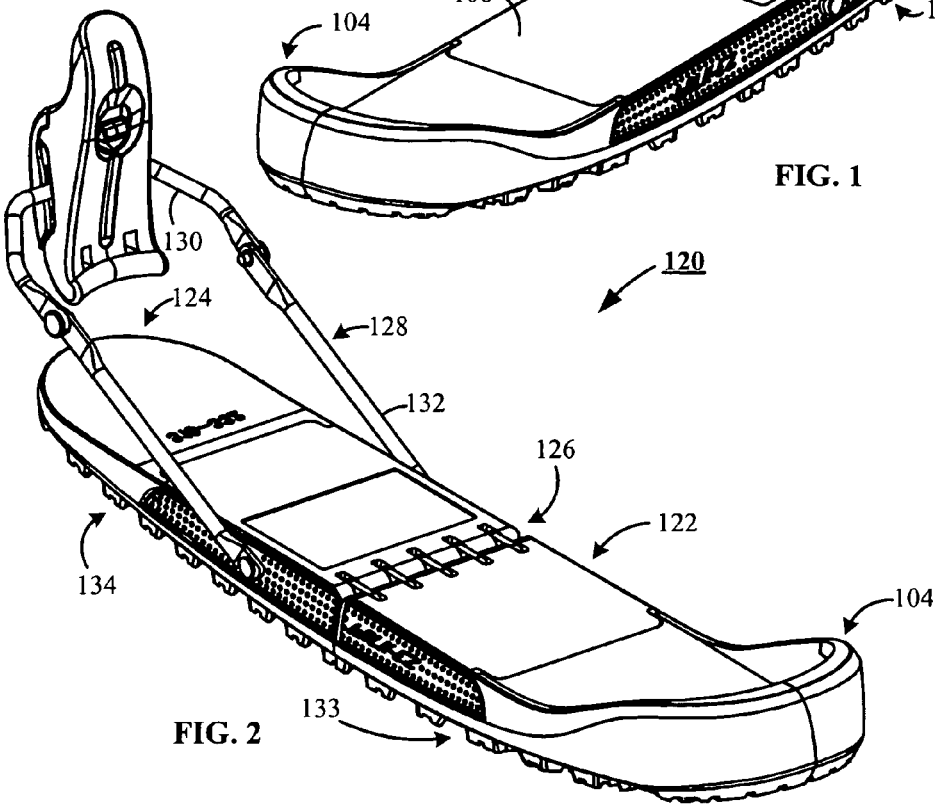
FIG. 2 shows a top perspective view of an alternate embodiment of the inventive detachable sole.

Turning to FIG. 2, shown therein is an alternate preferred embodiment of the inventive detachable sole 120. In contrast to the detachable sole 100 (of FIG. 1), the detachable sole 120 includes a first sole portion 122 and a second sole portion 124 secured together by a hinge portion 126. Additionally, the attachment hoop 108 (of FIG. 1) of the detachable sole 100 differs from an attachment hoop 128 of the inventive detachable sole 120. The attachment hoop 128 provides two portions, a latch attachment portion 130 and a heel chassis attachment portion 132 hinged to the latch attachment portion 130. It is noted however that the inventive detachable sole 120 and the inventive detachable sole 100 share the latch 110 in common.

Figure 3:
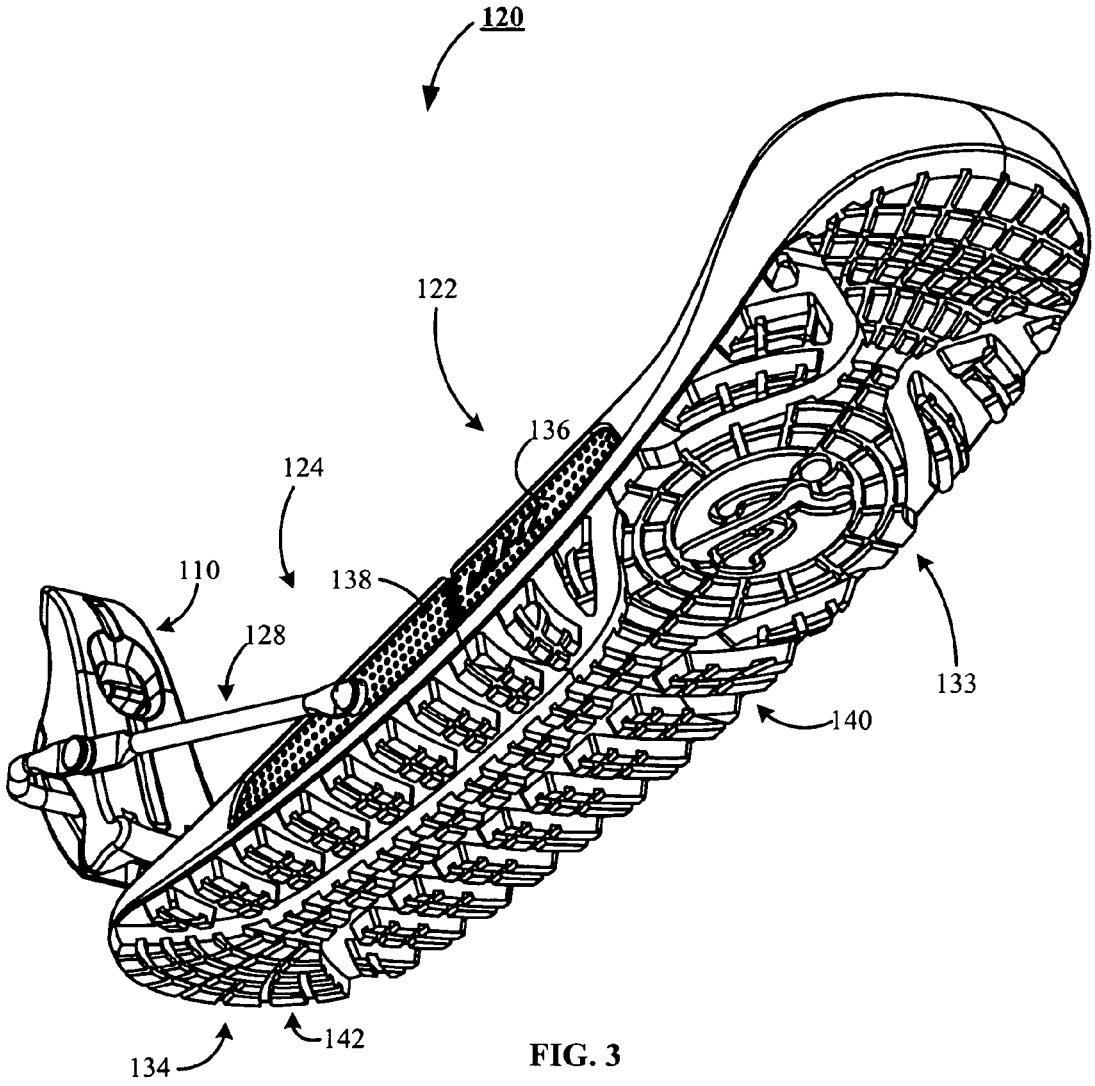
FIG. 3 is a bottom perspective view of tread portions of the inventive detachable sole of FIG. 2.

FIG. 3 shows the first sole portion 122 includes a toe tread portion 133, and the second sole portion 124 includes a heel tread portion 134. As with the tread portion 102 (of FIG. 1), the toe and heel tread portions 133,134 are preferably attached through the use of an overmold process. FIG. 3 further shows that the first sole portion 122 includes a side cap 136, and the second sole portion 124 includes a side cap 138. It will be understood that a tread pattern 140 of the toe tread portion 133, and a tread pattern 142 of the heel tread portion 134 represent preferred tread patterns, and do not impose limitations on the present invention. Those skilled in the art understand that alternate tread patterns may be utilized, and slip resistance mechanisms such as studs (similar to studs used on studded snow tires) may be incorporated within tread patterns 140 and 142, which fall within the scope of the present invention.

Figure 4:
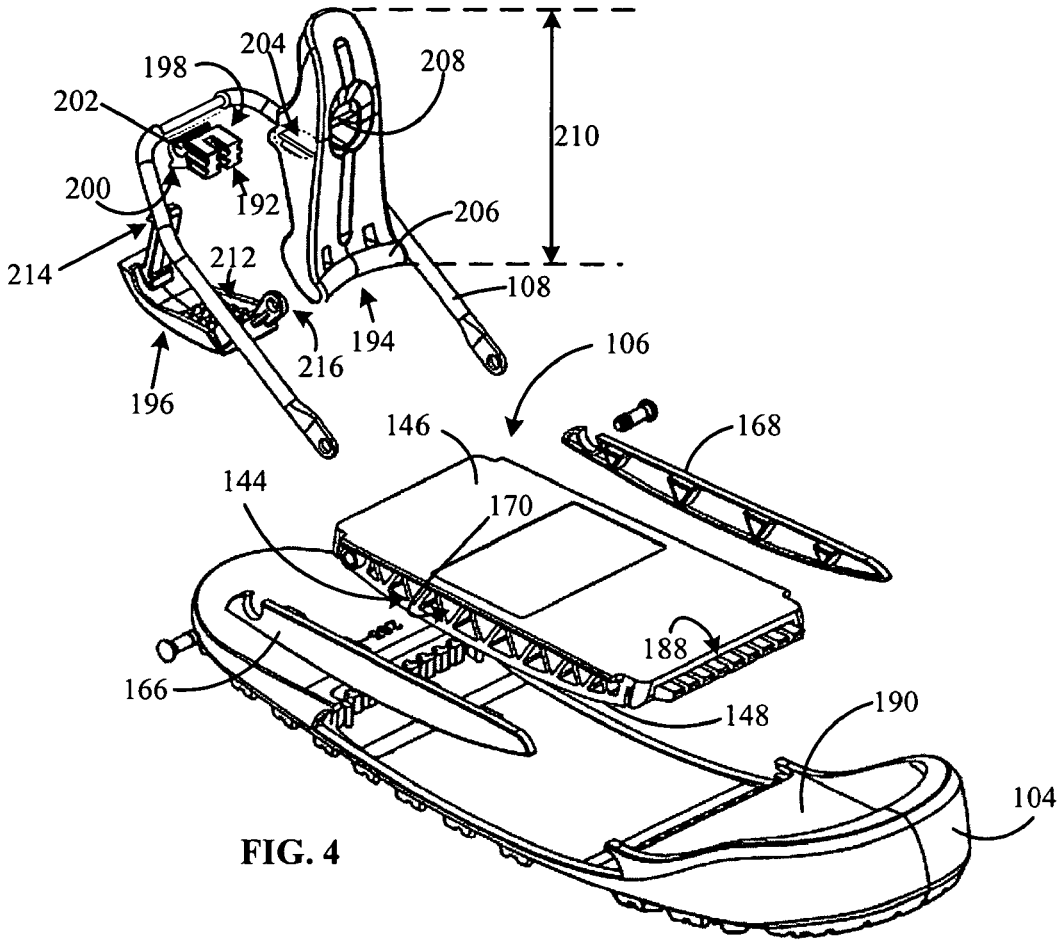
FIG. 4 is an exploded perspective view of the inventive detachable sole of FIG. 1.
Figure 5:
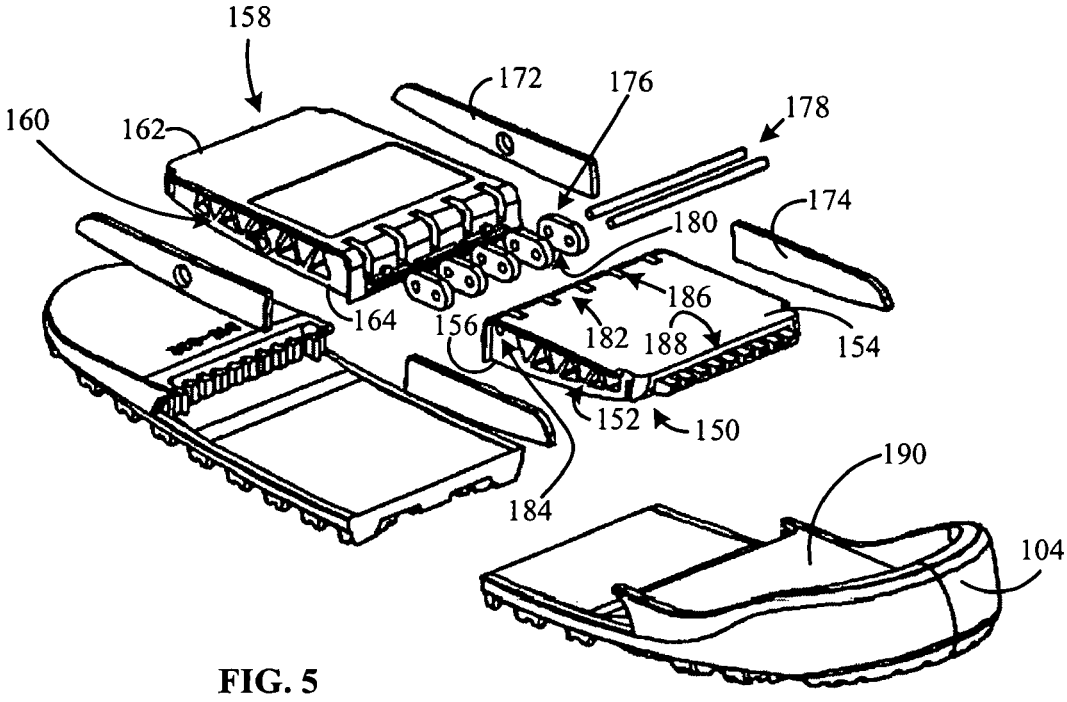
FIG. 5 is an exploded perspective view of the inventive detachable sole of FIG. 2.

The exploded perspective views of the inventive detachable soles 100 and 120 of FIG. 4 and FIG. 5 respectively may be best viewed in concert to provide an enhanced understanding of the commonalities and differences between the inventive detachable soles 100 and 120.

FIG. 4 shows the chassis 106 includes a baffled support matrix 144 interposed between a top chassis portion 146 and a bottom chassis portion 148. FIG. 5 shows that the first sole portion 122 includes a toe chassis portion 150 constructed with a baffled support matrix 152 interposed between a top chassis portion 154 and a bottom chassis portion 156. The second sole portion 124 includes a heel chassis portion 158 constructed with a baffled support matrix 160 interposed between a top chassis portion 162 and a bottom chassis portion 164.

FIG. 4 shows the inventive detachable sole 100 includes a right side cap 166 and a left side cap 168. When the side caps 166 and 168 are attached to the baffled support matrix 144, debris is prevented from entering a plurality of cavities 170. It is noted that the plurality of cavities 170 collectively form the baffling members of the baffled support matrix 144. In addition to the side caps 136 and 138 (of FIG. 3), FIG. 5 further shows the inventive detachable sole 120 includes a pair of the left side caps 172 and 174, which are provided to preclude entry of debris into the baffled support matrix 152.

The hinge portion 126, as shown by FIG. 5, includes a plurality of hinge knuckles 176, and a pair of hinge pins 178. Each hinge knuckle 176 provides a pair of hinge pin apertures 180, and each hinge pin 178 is configured for sliding engagement within the hinge pin apertures 180. To accommodate each hinge knuckle 176, the toe chassis portion 150, and the heel chassis portion 158 each provide a plurality of hinge pin confinement portions 182, wherein each hinge pin confinement portions provides a passageway 184 sized to snugly accommodate each hinge pin 178 in mating contact. Interposed between each hinge pin confinement portions 182 are hinge knuckle reception cavities 186. Each hinge knuckle reception cavities 186 of the toe chassis portion 150 is positioned to align directly across from a corresponding hinge knuckle reception cavity 186 of the heel chassis portion 158.

When each the toe and heel chassis portions, 150,158 are outlined for mating with the hinge portion 126, each of the plurality of hinge knuckles are deposited within the hinge knuckle reception cavities 186, and each hinge pin is encouraged through the respective passageways 184 of the toe and heel chassis portions 150, 158 to combine the first sole portion 122 with the second sole portion 124 to form the inventive detachable sole 120.

As can be seen in FIG. 4, the chassis 106 includes a plurality of overmold interface cavities 188, which have been found useful in enhancing an ability of the tread portion 102 to adhere to the chassis 106. Preferably, during an overmold process, a selected polymer used in forming the tread portion 102 is forced through each of the overmold interface cavities 188, and reflowed together to form a continuous surface 190 adjacent to top chassis portion 146. The continuous surface 190 provides a bridge-way between the chassis 106 and the toe confinement portion 104. A quasi pliable polymer such as the thermoplastic elastimer resin (TPE), or a polyurethane is preferable for use in forming the tread portion 102, the continuous surface 190, and the toe confinement portion 104 because the selection of a quasi pliable polymer accommodates various toe configurations of a mating ankle and foot covering, such as a ski boot 220 (of FIG. 7). In a preferred embodiment, the quasi pliable polymer continuous surface 190, and the toe confinement portion 104 have been found useful in holding the inventive detachable sole 120 under tension when attached to the ski boot 220. However, as those skilled in the art will recognize, alternate methods of providing a tensile load to the detachable sole 120 to aid in maintaining a snug fit between the ski boot 220 and the inventive detachable sole 120 may be provided, without deviation from the scope and spirit of the present invention, for example, through use of a spring configuration.

The latch 110 of FIG. 4, which in a preferred embodiment is an over-center latch 110 that includes three primary components: a latch block 192, a latch body 194, and a latch door 196. The latch block 192 provides a latch body engagement feature 198, a latch door engagement feature 200, and an attachment hoop attachment feature 202. The latch body 194 provides a plurality of tension adjustment members 204 (one shown in cutaway view), an over-center pivot feature 206, and a latch receptacle 208.

In a preferred embodiment, the latch body engagement feature 198 of the latch block 192 is slid into engagement with a selected one of the plurality of tension adjustment members 204. Because the plurality of tension adjustment members 204 extend along a length 210 of the latch body 194, the selection of a specific tension adjustment member 204 determines a holding force imparted by the attachment hoop 108 on the chassis 106, which determines how tightly the inventive detachable sole 100 is secured adjacent a mating ankle and foot covering, such as orthopedic device 218 (of FIG. 6).

The latch door 196 is configured for engagement with the latch block 192 and the latch body 194. The latch body provides a plurality of latch block support channels 212, a latch door latch 214, and a pivot detent 216. Once the selection has been made for the particular tension adjustment member 204, and the latch body engagement feature 198 has been slid onto the selected tension adjustment member 204, a position of the latch block 192 relative to the latch receptacle 208 can be determined. When the relative position of the latch block 192 to the latch receptacle 208 has been determined, a specific latch block support channel 212 is selected by rotating the latch door latch 214 about the pivot detent 216 to engage the latch door engagement feature 200 with the latch receptacle 208. Once positioned, the latch door 196 mitigates a buildup of ice and snow around the interface of the latch body engagement feature 198 and the selected tension adjustment member 204.

Figure 6:
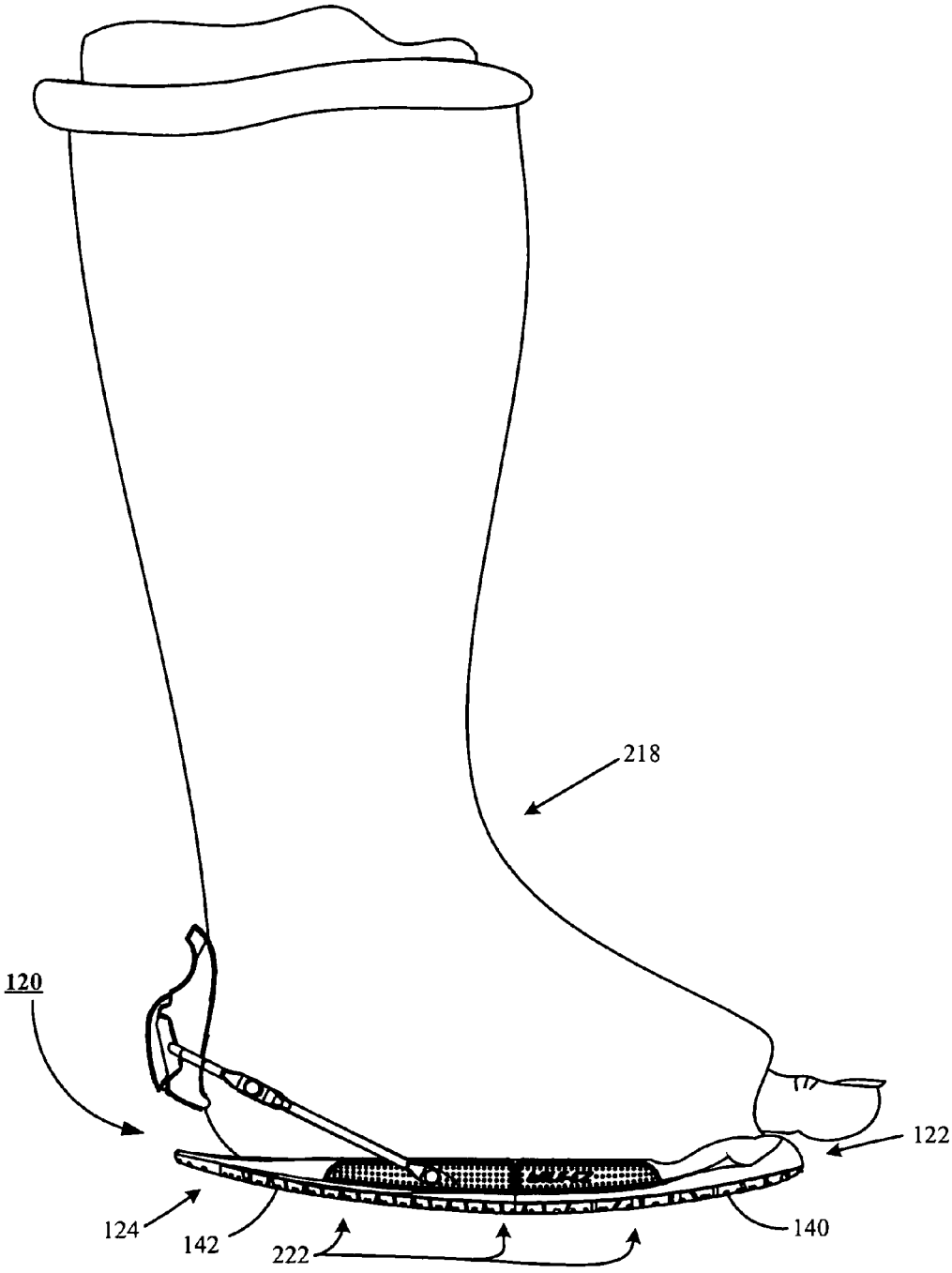
FIG. 6 shows a side elevational view of an alternative embodiment of the inventive detachable sole secured to an ankle and foot covering.
Figure 7:
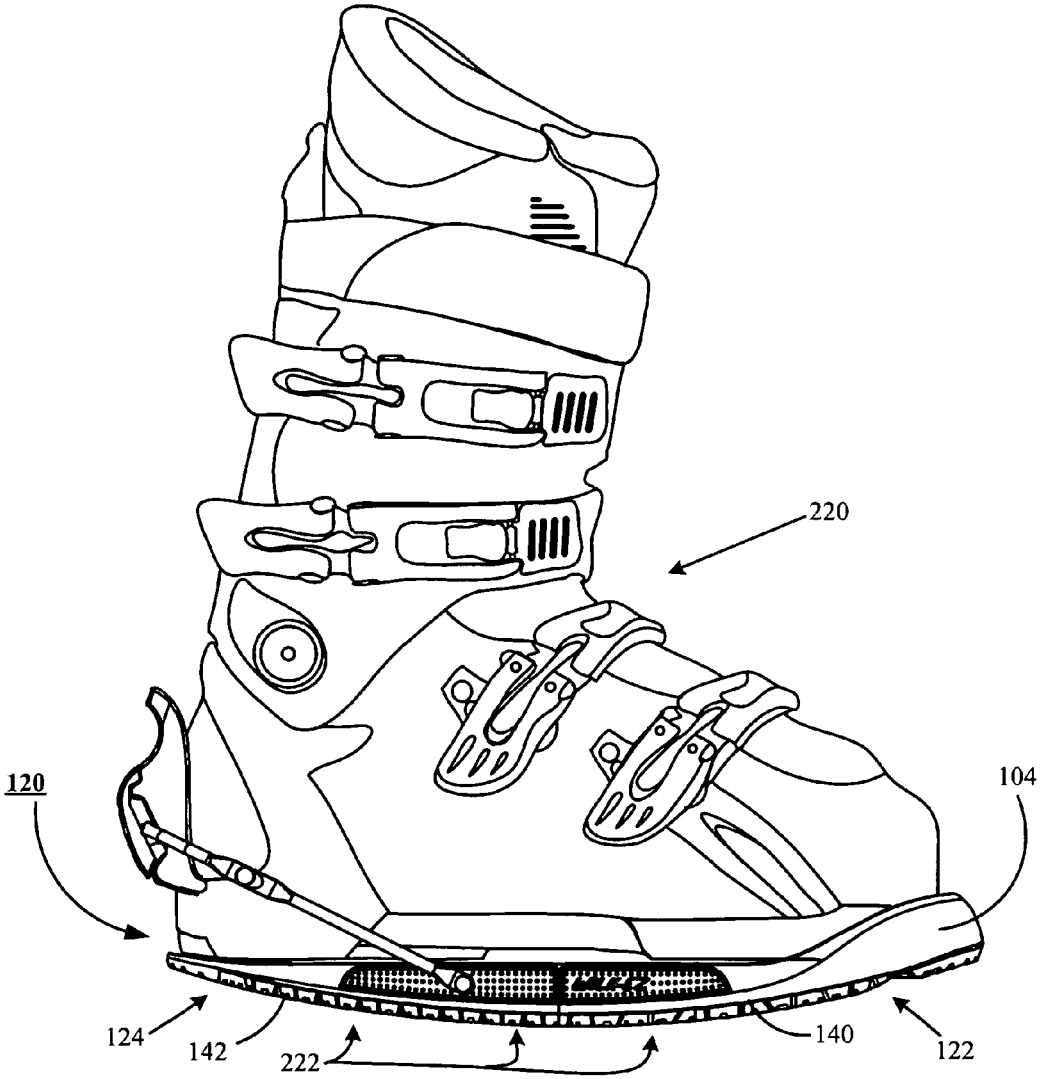
FIG. 7 illustrates a side elevational view of the inventive detachable sole of FIG. 2 secured to an alternate ankle and foot covering.

FIGS. 6 and 7 each show an example of a use for the inventive detachable sole 120. The applied use of the inventive detachable sole 120 depicted by FIG. 6 resides within the medical arts. The inventive detachable sole 120, provides an enhanced walking ability for an individual wearing an orthopedic device such as a cast 218. The enhanced walking ability provided for an individual wearing the cast 218 results from the concave shape 222 of the inventive detachable sole 120, and the preferred tread patterns 140 and 142, respectively of the first sole portion 122 and the second sole portion 124.

The applied use of the inventive detachable sole 120 depicted by FIG. 7 resides within the sports equipment arts. The inventive detachable sole 120, provides an enhanced walking ability for an individual wearing, for example an Alpine type ski boot, such as 220. The enhanced walking ability provided for an individual wearing the ski boot 220 results from the concave shape 222 of the inventive detachable sole 120, the preferred tread patterns 140 and 142, respectively of the first sole portion 122 and the second sole portion 124, the toe confinement portion 104, and the adjustability features of the over-center latch 110.

Figure 8:
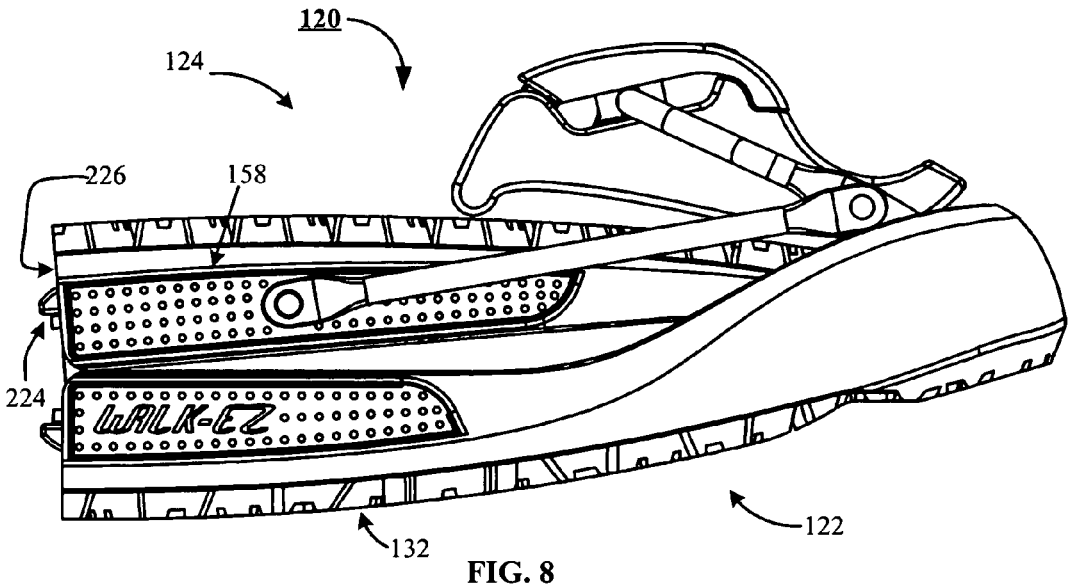
FIG. 8 is a side elevational view of the inventive detachable sole of FIG. 2 shown in a collapsed configuration ready for storage.
Figure 9:
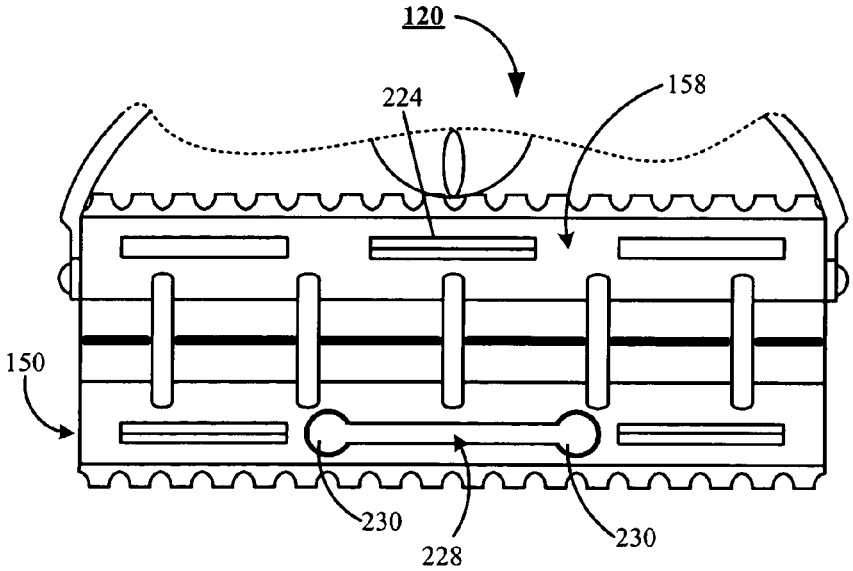
FIG. 9 is a rear elevational view of the inventive detachable sole of FIG. 2 shown in a collapsed configuration ready for storage.

FIG. 8 provides a best view of a chassis stabilization member 224, which extends from the proximal end 226 of the heel chassis portion 158, while FIG. 9 provides a best view of a chassis stabilization aperture 228. The chassis stabilization aperture 228 is configured to accommodate penetration of the chassis stabilization member 224 when the heel chassis portion 158 is folded into alignment with the toe chassis portion 150. FIG. 9 further shows the inclusion of a pair of retention stud apertures 230. The retention stud apertures 230 accommodate penetration of a pair of respective chassis retention studs 232 of FIGS. 10 and 11.

It will be noted that FIG. 8 shows the inventive detachable sole 120 to be in a partially folded position. It will be understood that the depiction of the inventive detachable sole 120 in a partially folded position was provided to enhance an understanding of the present invention and does not impose any limitations on the present invention. In a preferred embodiment, in a fully folded position, the first sole portion 122 aligns with the second sole portion 124 in a substantially flat continuous manner.

Figure 10:
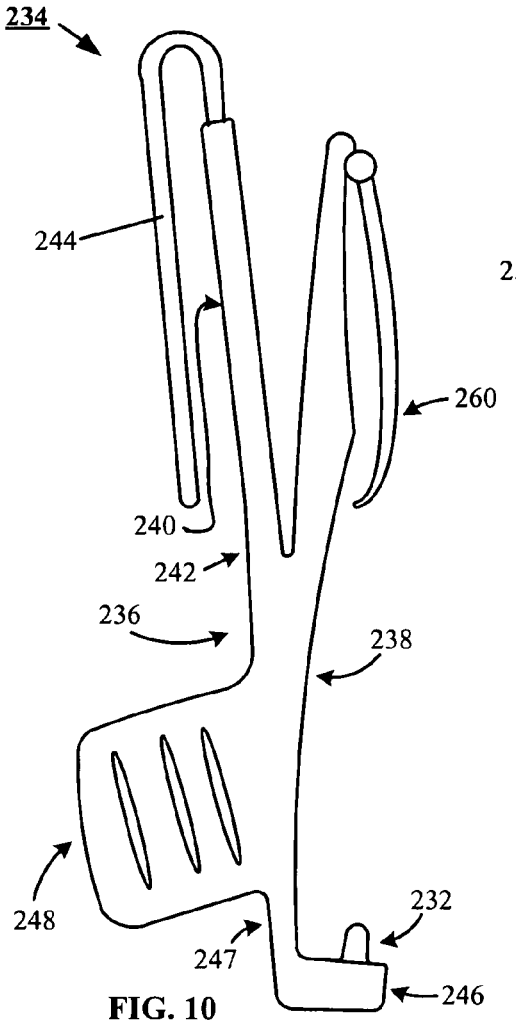
FIG. 10 is a first side elevational view of an inventive detachable sole storage rack configured for interaction with the inventive detachable sole of FIG. 2.
Figure 11:
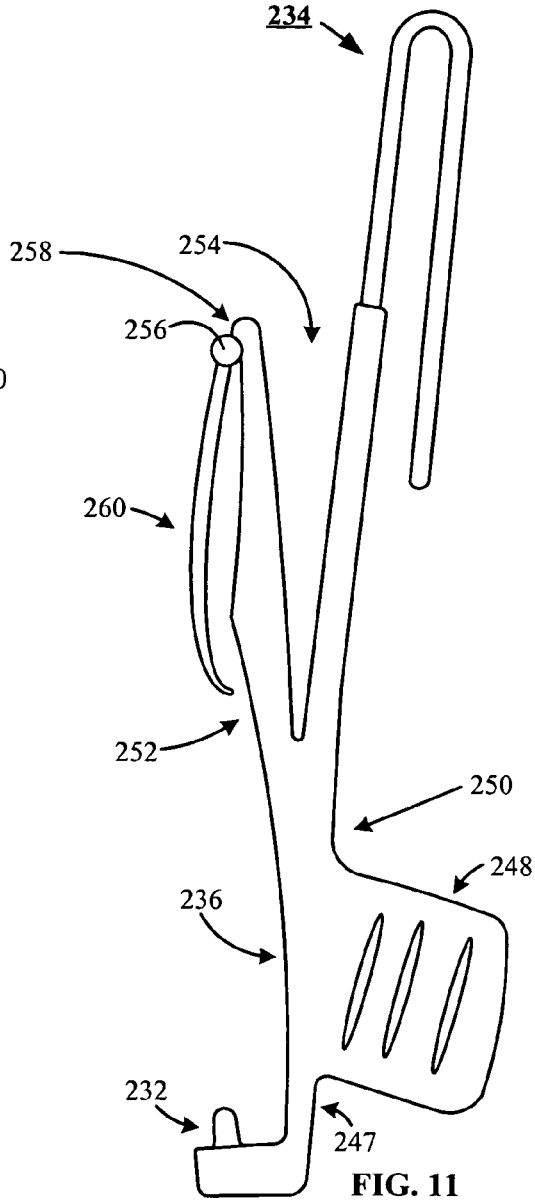
FIG. 11 is a second side elevational view of the inventive detachable sole storage rack of FIG. 10.

Turning to FIGS. 10 and 11, a left side elevational view of a storage rack 234 is provided by FIG. 10, and a right side elevational view of the storage rack 234 is provided by FIG. 11. The storage rack 234 includes a main body portion 236 with a concave surface 238, configured for mating conformance with the toe tread portion 133 (of FIG. 8). A hook adjustment portion 240 projects from a proximal end 242 of the main body portion 236. The hook adjustment portion 240 supports and accommodates a hook attachment member 244. The hook attachment member 244 is useful for attachment of the inventive detachable sole 120 to an ankle and foot covering such as the ski boot 220 of FIG. 7.

In a preferred embodiment, the hook adjustment portion 240 provides for an adjustment, in a vertical direction (as shown by FIG. 11), of the hook attachment member 244 to accommodate varying sizes of ski boots, or orthopedic devices. The storage rack 234 further includes a chassis support shelf 246 extending from a proximal end 247 of the main body portion 236. The chassis support shelf 246 provides a support member for the chassis retention studs 232. The chassis retention studs 232 interact with the retention stud apertures 230 (of FIG. 9) to position the toe tread portion 133 adjacent the main body portion 236. FIG. 11 further shows a main body support 248 extending from a mid-portion 250 of the main body portion 236.

FIG. 11 further shows a strap support member 252 projecting from the proximal end 242 of the main body portion 236. A garment confinement slot 254 is formed between the hook adjustment portion 240 and said strap support member 252. With the inventive detachable sole 120 attached to a ski boot, such as ski boot 220 (of FIG. 7), the garment confinement slot 254 accommodates placement of a garment portion, such as a pant leg of the pair of ski pants (not shown). To secure the inventive detachable sole 120 to the ski boot 220 (as shown in FIG. 7), a strap pin 256 is attached to a distal end 258 of the strap support member 252, and a strap 260 attached to the strap pin 256. The strap 260 interacts with the over-center latch 110 to confine the toe tread portion 133 adjacent the main body portion 236.

Figure 12:
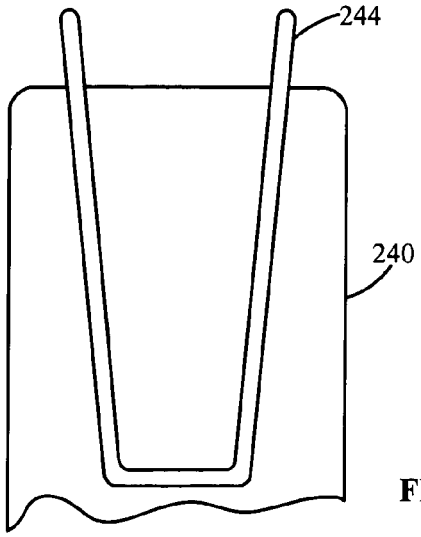
FIG. 12 is a partial cutaway rear elevational view of the inventive detachable sole storage rack of FIG. 10.

FIG. 12 is provided to enhance an understanding of a preferred configuration of the hook attachment member 244 relative to the hook adjustment portion 240. In a preferred embodiment the hook attachment member 244 is formed from stainless spring steel, however those skilled in the art will understand that alternate materials and configurations may provide substitute design choices for the hook attachment member 244, and still remain within the scope and spirit of the present intention.

Figure 13:
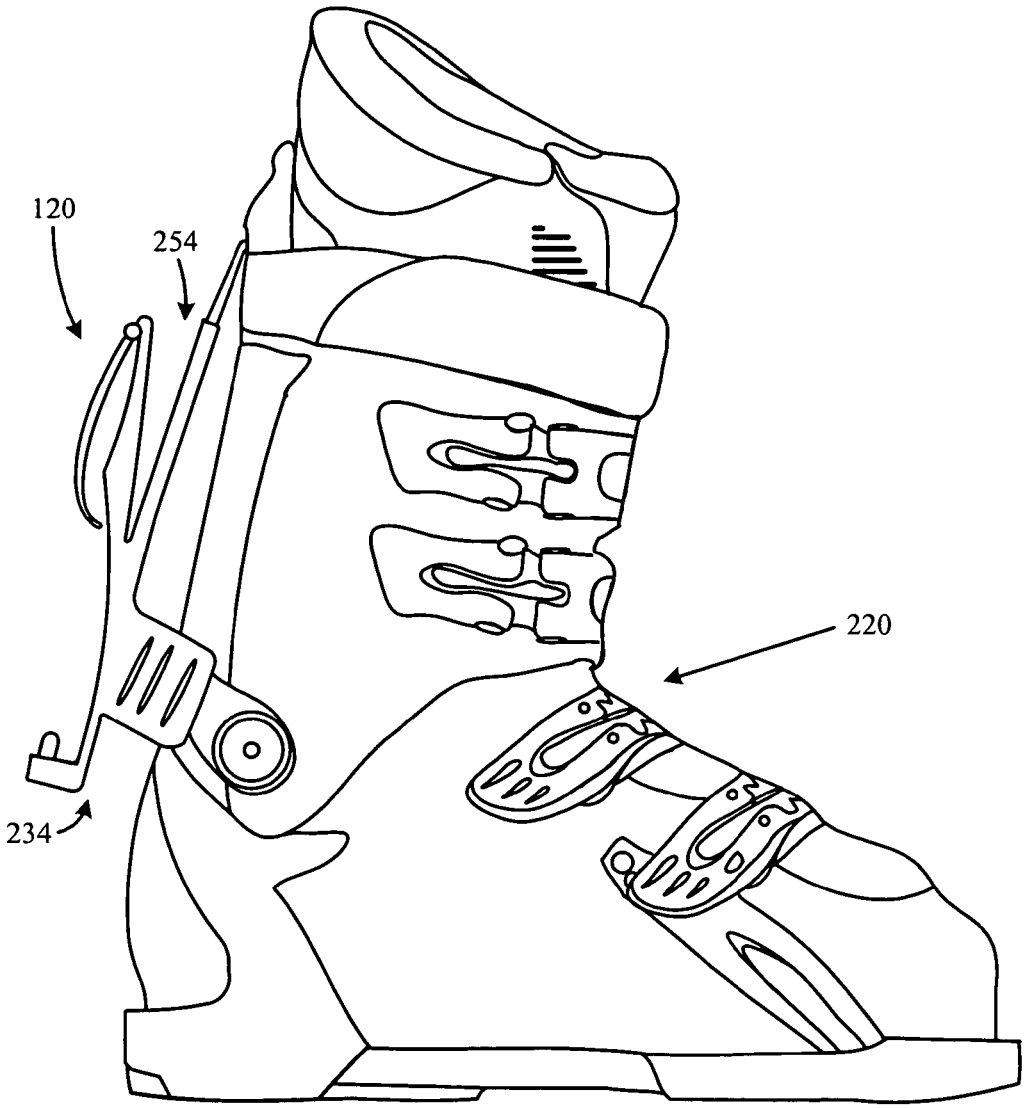
FIG. 13 is a side elevational view of the inventive detachable sole storage rack of FIG. 10 attached to the alternate ankle and foot covering of FIG. 7.
Figure 14:
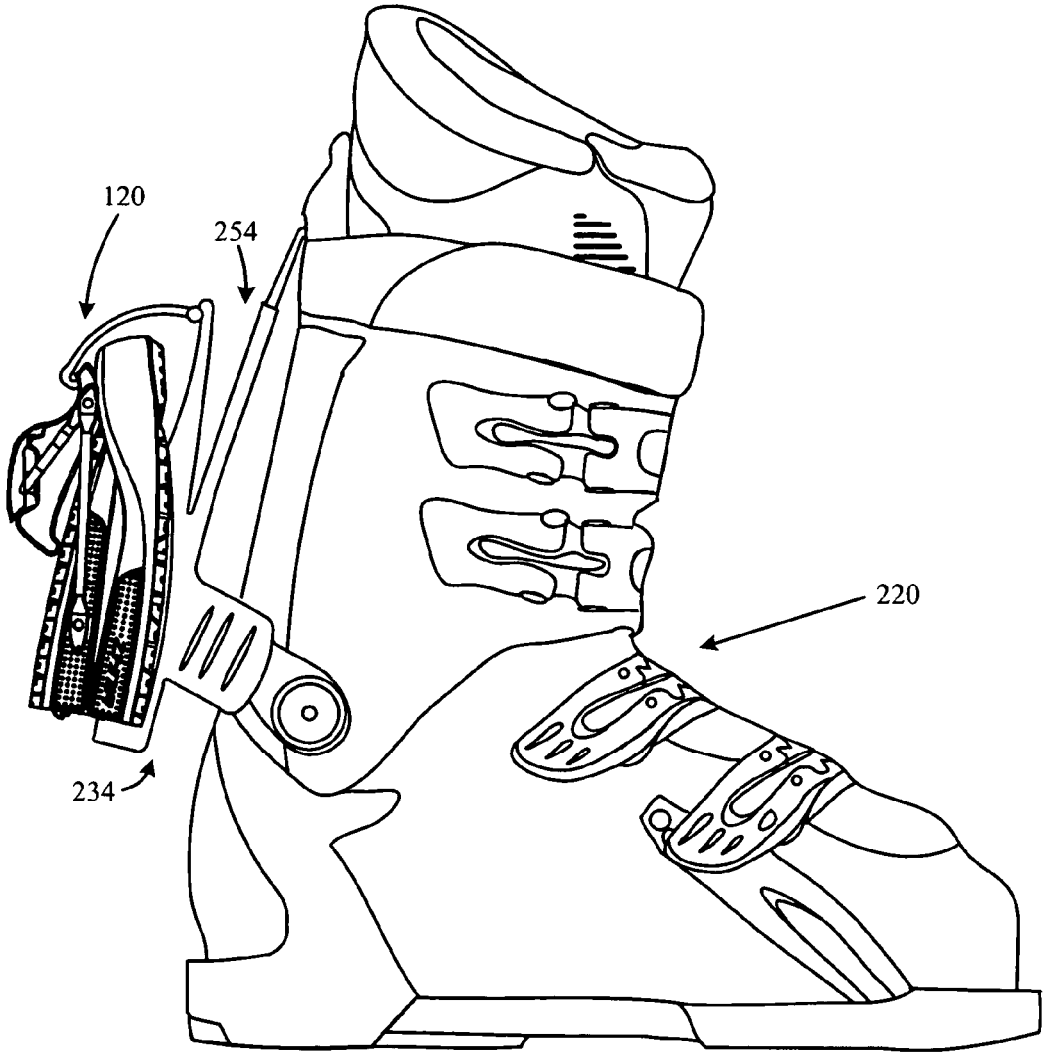
FIG. 14 is a side elevational view of the inventive combination of the present invention.

FIG. 13 provides an elevational view of a preferred embodiment configuration of the storage rack 234 attached to ski boot 220, while FIG. 14 serves to shows the configuration of FIG. 13 with the addition of the inventive detachable sole 120 of the present invention. By viewing FIG. 14 it will be noted that the storage rack 234, when attached to the ski boot 220, provides for convenient storage of the inventive detachable sole 120, when the inventive detachable sole 120 is detached from the ski boot 220, for example during periods of time in which an individual is engaged in skiing down a slope.

Figure 15:
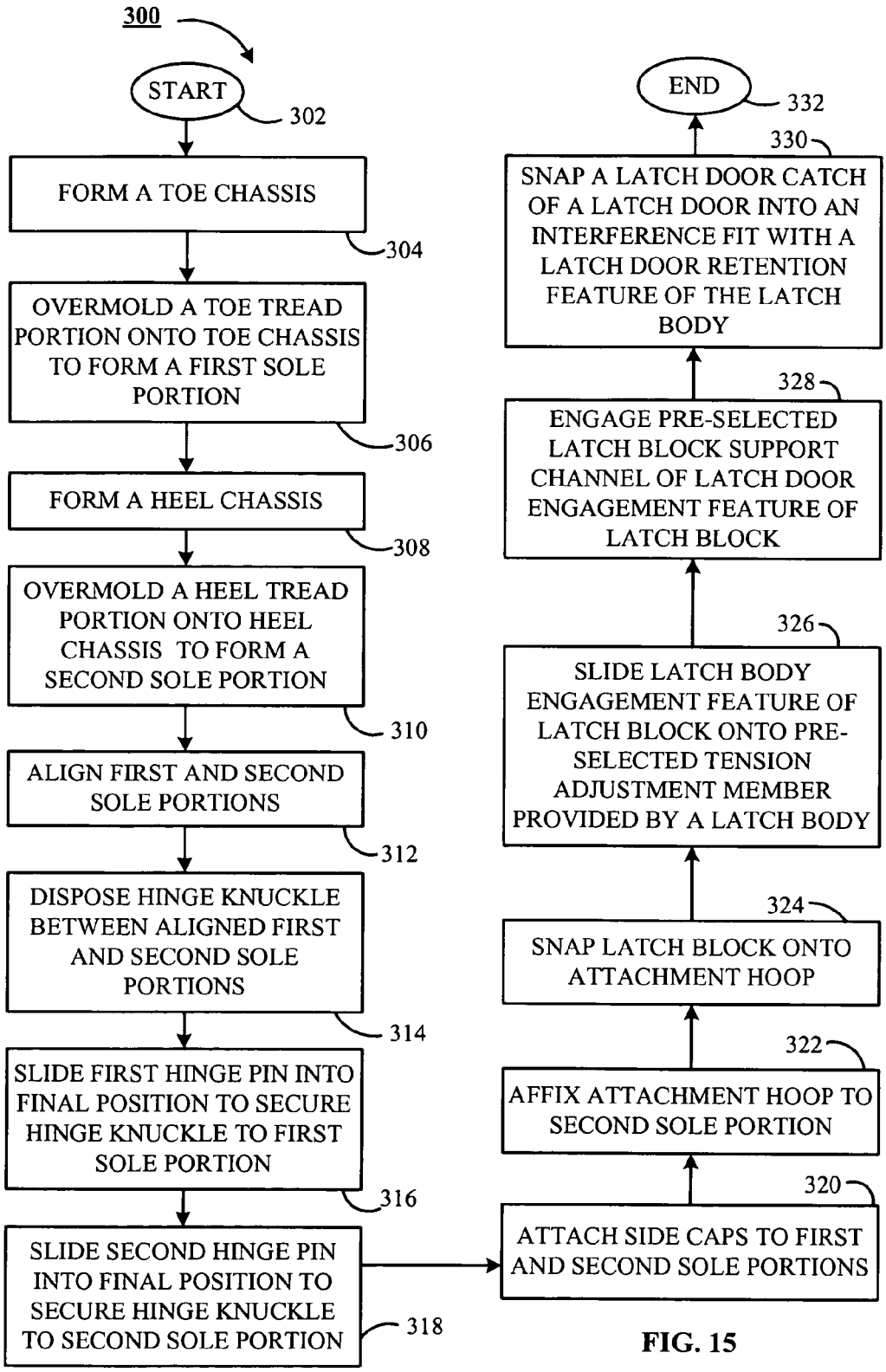
FIG. 15 is a flow diagram of the method of making the inventive detachable sole of FIG. 2.

Flowchart 300 of FIG. 15 shows method steps of a process of making an inventive detachable sole (such as 120). The process commences at start step 302 and continues at process step 304. At process step 304, a toe chassis portion (such as 150) is formed, and at process step 306 a toe tread portion (such as 133) is overmolded onto the toe chassis. At process step 308, a heel chassis (such as 158) is formed and at process step 310 a heel tread portion (such as 134) is overmolded onto the heel chassis.

At process step 312, a first sole portion (such as 122) is aligned to a second sole portion (such as 124). With the first and second sole portions aligned, at process step 314, a process of installing a hinge portion (such as 126) is commenced by disposing each of a plurality of hinge knuckles (such as 176) within corresponding knuckle reception cavities (such as 186). At process step 316, a first of a pair of hinge pins (such as 178) is slid into its final position to secure the hinge knuckle to the first sole portion, and at process step 318 the second of the pair of hinge pins is slid into position to secure the hinge knuckle to the second sole portion.

At process step 320, side caps (such as 136, 138, 172, and 174) are attached to each of the first and second sole portions. The attachment of the side caps mitigates encroachment of debris from migrating into each of the plurality of cavities (such as 170), which collectively form baffling members of a baffled support matrix (such as 144). At process step 322, an attachment hoop (such as 128) is attached to the second sole portion, and at process step 324 a latch block (such as 192) is snapped onto the attachment hoop.

At process step 326, a latch body engagement feature (such as 198), is slid onto a pre-selected tension adjustment member (such as 204), provided by a latch body (such as 194). At process step 328, a pre-selected latch body support channel (such as 212) of a latch door (such as 196) engages a latch door engagement feature (such as 200) of the latch block. At process step 330, a latch door latch (such as 214) is snapped into an interference fit with a latch receptacle (such as 208) of the latch body, and the process concludes at end process step 332.

Figure 16:
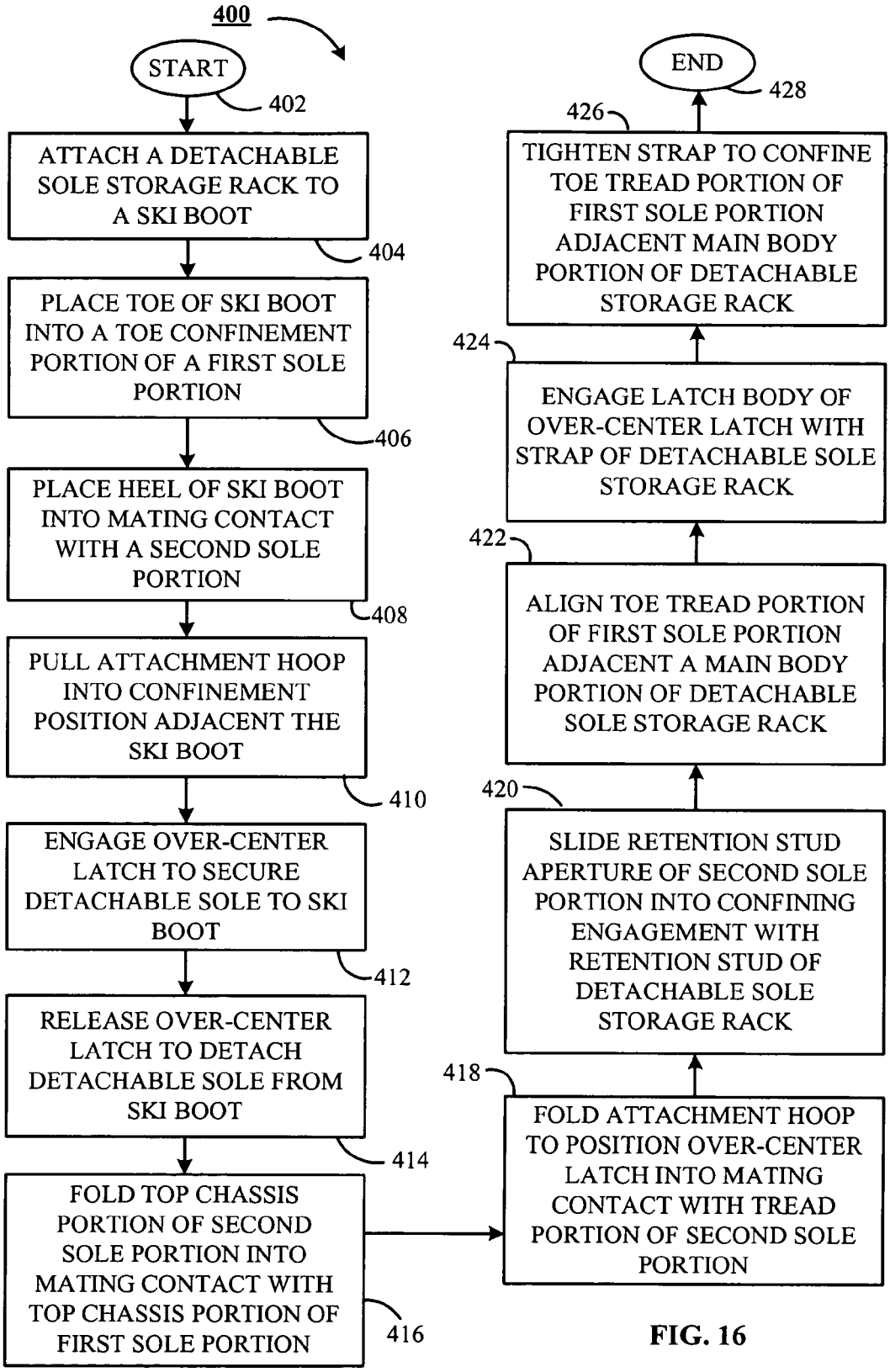
FIG. 16 is flow diagram of a method of using the inventive combination of FIG. 14.

Flowchart 400 of FIG. 16 shows method steps of a process of using an inventive detachable sole (such as 120). The process commences at start step 402 and continues at process step 404. At process step 404, a detachable sole storage rack (such as 234), is attached to a ski boot (such as 220). At process step 406, a toe of a ski boot is placed into a toe confinement portion (such as 104) of a first sole portion (such as 122). At process 408, a heel of the ski boot is placed in mating contact with a second sole portion (such as 124). At process step 410, an attachment hoop (such as 128) is pulled into a confinement position adjacent the ski boot, and at process step 412 an over-center latch (such as 110) is engaged to secure the detachable sole to the ski boot.

At process step 414, the over-center latch is released to detach the detachable sole from the ski boot. At process step 416, a top chassis portion (such as 162) of the second sole portion is folded into mating contact with a top chassis portion (such as 154) of the first sole portion. At process step 418, the attachment hoop is folded to position the over-center latch into mating contact with a heel tread portion (such as 134) of the second sole portion. At process step 420, a pair of retention stud apertures (such as 230), are slid into confining engagement with a pair of chassis retention studs (such as 232). At process step 422, a toe tread portion (such as 133) of the first sole portion is aligned adjacent a main body portion (such as 236) of the detachable sole storage rack.

A latch body (such as 194) of the over-center latch is lashed with a strap (such as 260) to the detachable storage rack at process step 424. At process step 426, the strap is tightened to confine the toe tread portion of the first sole portion adjacent the main body portion of the detachable storage rack and the process concludes at end process step 428.

Figure 17:
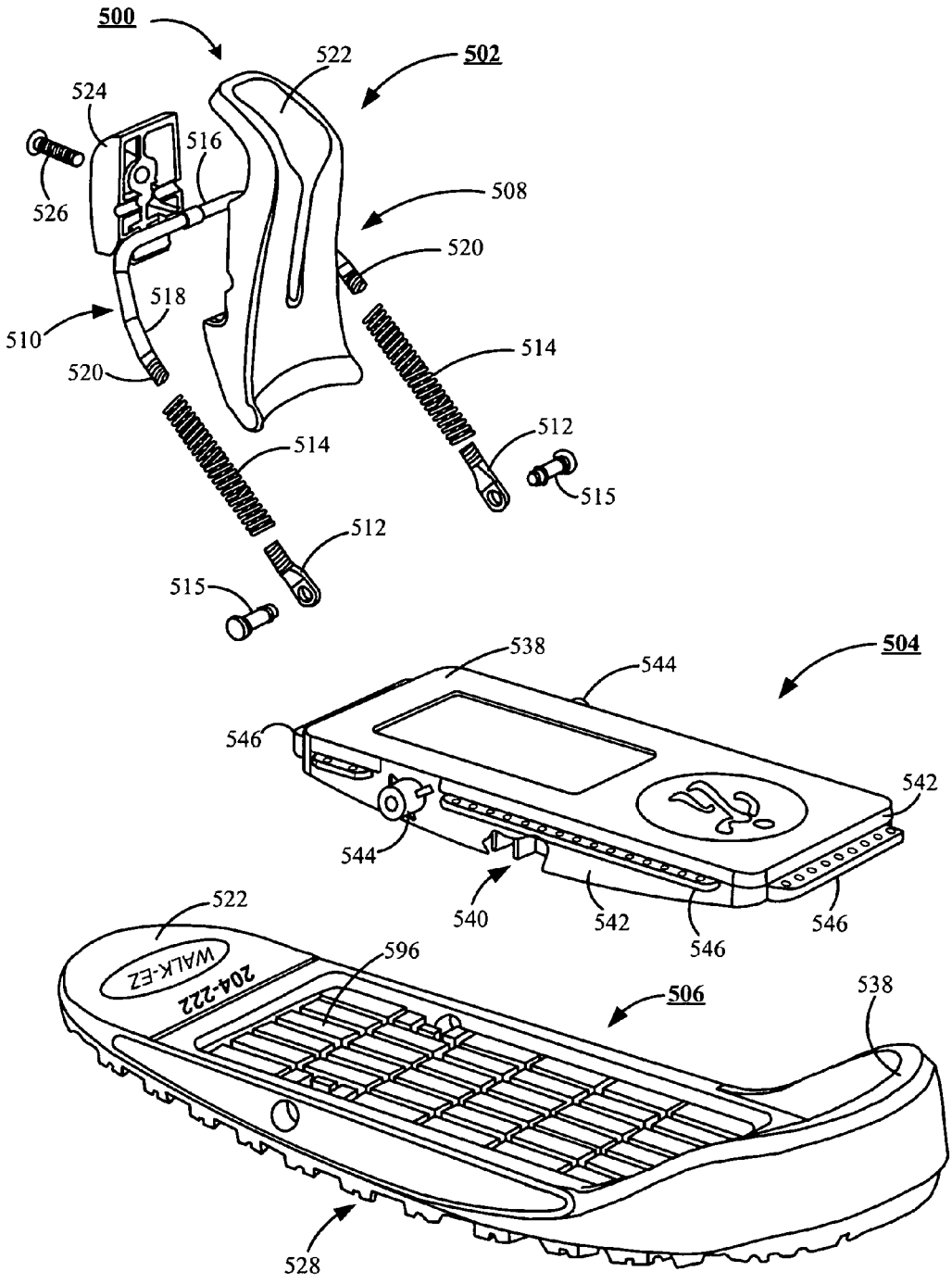
FIG. 17 is an exploded perspective view of another alternate embodiment of an inventive detachable sole.

FIG. 17 shows another alternate embodiment of the inventive detachable sole 500 that includes a latch assembly 502, a chassis 504, and a sole portion 506. The latch assembly 502 includes a latch 508, a latch support 510, an attachment member 512, an adjustment member 514, and attachment hardware 515 for use in securing the latch assembly to the chassis 504. The latch support 510 preferably includes a latch mount portion 516, an alignment portion 518 projecting from the latch mount portion 516, and a first threaded portion 520 communicating with the alignment portion 518. The first threaded portion 520 is preferably configured for interaction with the adjustment member 514.

Preferably, the latch assembly 502 provides the latch 508, which includes a latch body 522, a latch door, and fastener 526 used to secure the latch door 524 to the latch body 522. To secure the latch door 524 to the latch body 522, the latch body is positioned adjacent the latch mount portion 516. With the latch body 522 pressingly engaging the latch mount portion 516, the latch door 524 is fitted into abutting contact with the latch body 522, and the fastener 526 is passed through the latch door 524 and secured into the latch body 522, thereby lockingly confining the latch support 510 between the latch door 524 and the latch body 522.

The sole portion 506 preferably includes a tread portion 528, a toe confinement portion 530, a heel portion 532, and a chassis support portion 534 interposed between the toe confinement portion 530 and the heel portion 532, and supported by the tread portion 528. The chassis support portion 532 provides a plurality of force absorption members 536 that enhance the feel of the inventive detachable sole 500 during its use.

In a preferred embodiment, the chassis 504 includes a top portion 538 that supports a web portion 540 (shown in partial cut-away), a plurality of side portions 542 that communicate with the top portion 538 to form an edge perimeter enclosing the web portion 540. It is noted that the web portion 540 is configured to accommodate the force absorption members 536 of the sole portion 506. Preferably the chassis 504 further provides an attachment feature 544 supported by a selected side portion of the plurality of side portions 542. Also, each side portion 542 preferably further supports a retention feature 546, which becomes encapsulated by the sole portion 506 during a process of overmolding the sole portion 506 onto the chassis 504.

Figure 18:
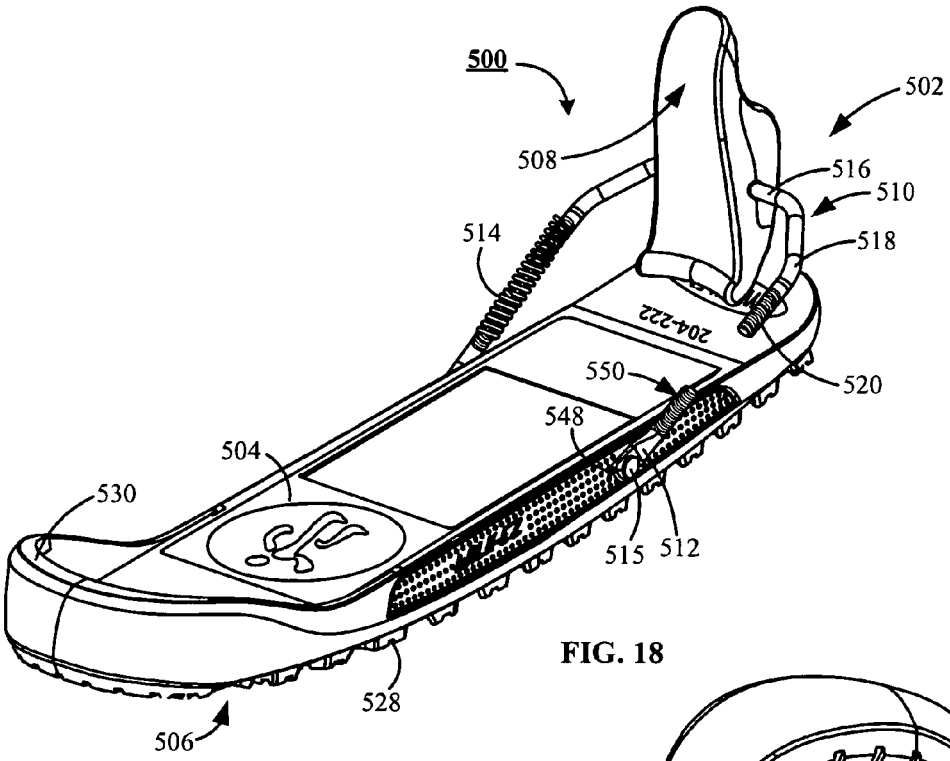
FIG. 18 shows a top perspective view of the inventive detachable sole of FIG. 17.

FIG. 18 shows the chassis 504 encapsulated by the sole 506, and the attachment member 512 secured to the chassis 504 by the attachment hardware 515. The latch 508 and the chassis 504 are formed from a glass filled polypropylene compound, in which the compound contains between 10-30% glass by volume, and preferably 20% glass by volume, and the tread portion 528, is preferably formed from a quasi pliable polymer such as the thermoplastic elastimer resin (TPE), or a polyurethane.

The latch support 510 provides the latch mount portion 516, upon which the latch 508 resides. The alignment portion 518 projects from the latch mount portion 516 and provides a first threaded portion 520, which preferably presents a left-handed thread.

The attachment member 512 provides an attachment aperture 548 (not separately shown) that accommodates passage of the attachment hardware 515, which secures the attachment member 512 to the chassis 504. The attachment member 512 further preferably provides a second threaded portion 550, which preferably presents a left-handed thread.

In a preferred embodiment, the left-hand thread presentation of the first threaded portion 520, is secured to the left-hand thread presentation of the second threaded portion 550 by an adjustment member 514. Preferably, the adjustment member 514 is formed from a stainless steel coiled spring; however, those skilled in the art will understand that alternate configurations and materials may be substituted for the preferred stainless steel coiled spring, without deviating from the scope of the present invention.

In a preferred embodiment, the preferred stainless steel coiled spring is a right-hand wound coil spring, and both the first and second threaded portions, 520 and 550, present left-hand female threads. The continuous coil body of the right-hand wound coil spring (having an inner diameter corresponding to the thread depth of the left-hand female threads of the first and second threaded portions, 520 and 550) forms a corresponding mating and continuous left-hand male thread. Accordingly, by rotating the right-hand coil spring counter-clockwise, the continuous coil body of the right-hand wound coil spring settles in, and adjusts itself to the pitch of the left-hand female threads of the first and second threaded portions, 520 and 550, and travels along the length of the corresponding first and second threaded portions, 520 and 550.

Figure 19:
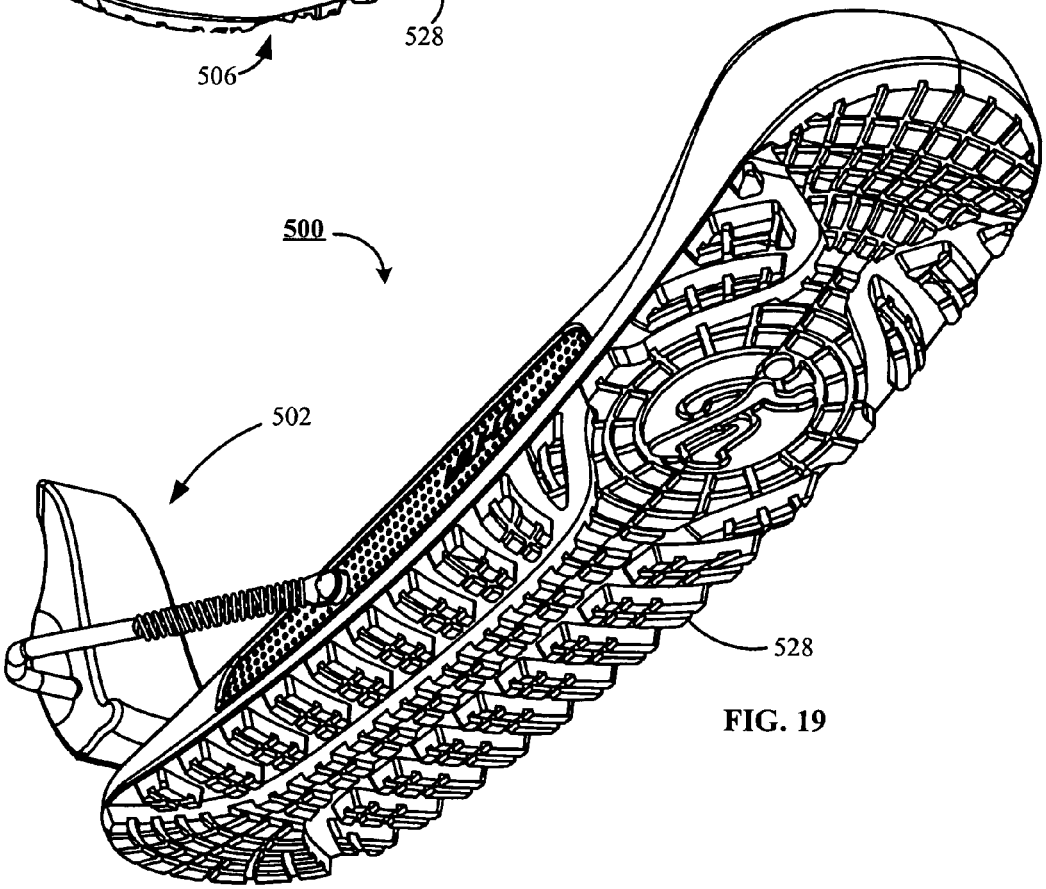
FIG. 19 shows a bottom perspective view of the inventive detachable sole of FIG. 17.

FIG. 19 provides a perspective of a convenient pattern of the tread 528. The particular configuration and arrangement selected provides a distinguishable look or pattern in snow, when the snow is tread upon by a user wearing the inventive detachable sole 500 no a pair of ski boots.

Figure 20:
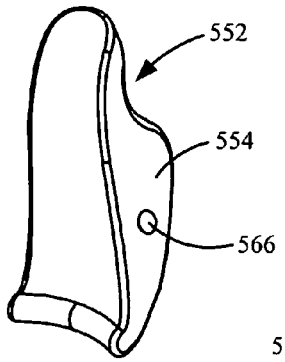
FIG. 20 illustrates a left perspective view of an alternate latch of the inventive detachable sole of FIG. 17.
Figure 21:
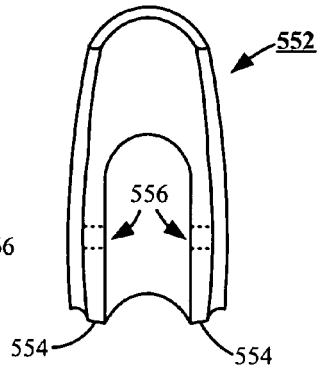
FIG. 21 is rear plan view of the latch of FIG. 20.
Figure 22:
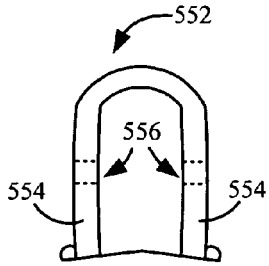
FIG. 22 is bottom elevational view of the latch of FIG. 20.

FIGS. 20, 21, and 22 each show a separate view of an alternate preferred latch embodiment 552 ("latch 552"), which is preferably formed from butyl rubber. By providing a pair of side walls 554 that include a mounting aperture 556, the latch 552 can be slid over the latch support 510 (of FIG. 17), and become stabilized about the latch mount portion 516 (of FIG. 17). Once slid into position, the configuration of the latch support 512 precludes shifting of the latch 552, relative to the latch mount portion 516, during normal use of the inventive detachable sole 500 of FIG. 23.

Figure 23:
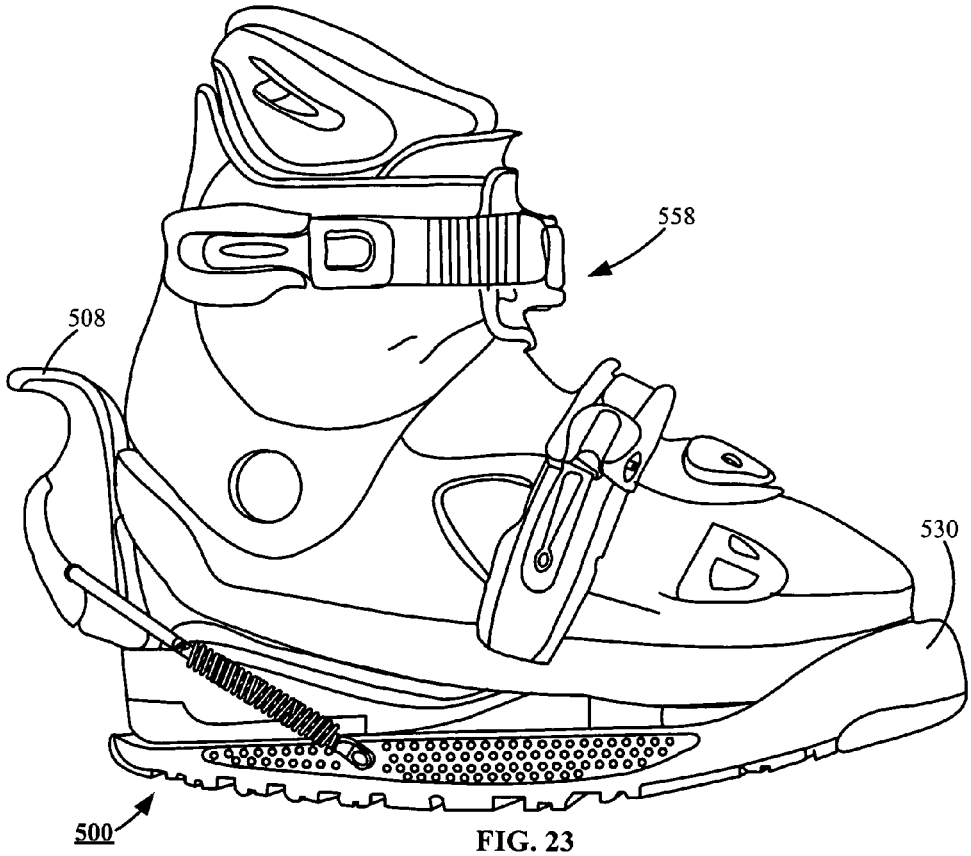
FIG. 23 is a side elevational view of an alternate inventive combination of the present invention.

FIG. 23 provides an elevational view of the inventive detachable sole 500 attached to a ski boot 558, in preparation for use by a skier.

Figure 24:
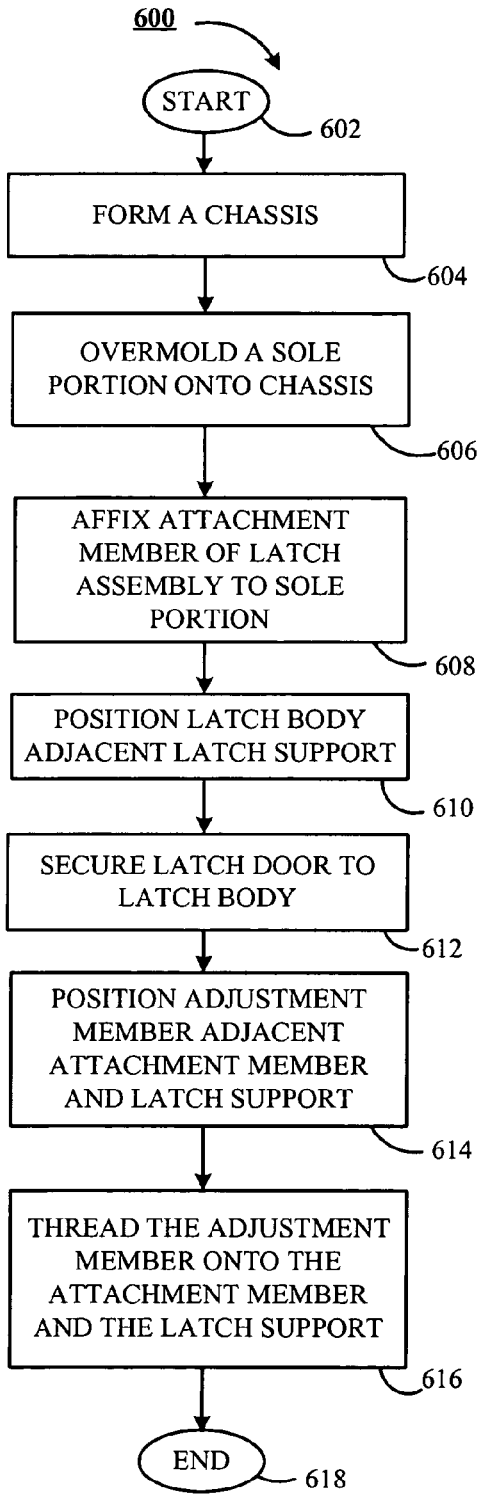
FIG. 24 is a flow diagram of the method of making the inventive detachable sole of FIG. 18.

Flowchart 600 of FIG. 24 shows method steps of a process of making an inventive detachable sole (such as 500). The process commences at process start step 602, and continues at process step 604. At process step 604, a chassis (such as 504) is formed, and at process step 606, a sole portion (such as 506) is overmolded onto the chassis. At process step 608, an attachment member (such as 512) is affixed to the chassis, and at process step 610, a latch body (such as 522) is positioned adjacent a latch support (such as 510).

At process step 612, a latch door (such as 524) is aligned with and secured to the latch body. At process step 614, an adjustment member (such as 514) is positioned adjacent the attachment member and the latch support, and at process step 616, the adjustment member is threaded onto the attachment member and the latch support. Following process step 616, the process concludes at end process step 618.

Figure 25:
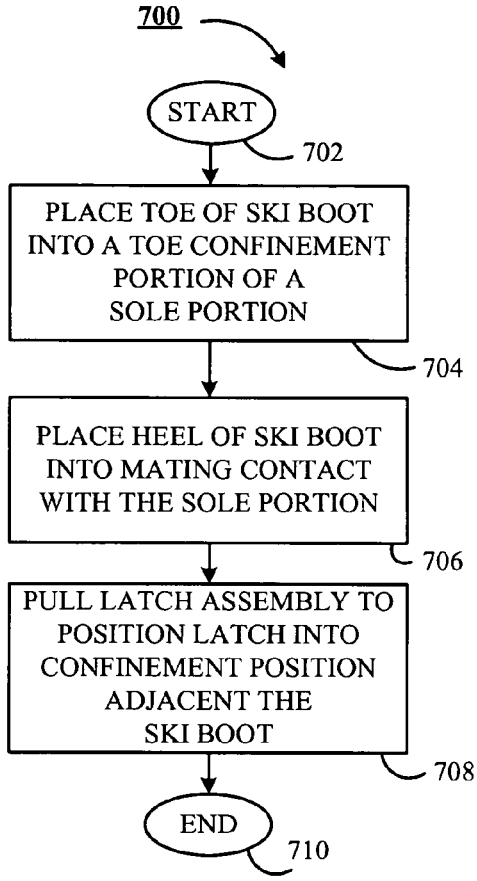
FIG. 25 is a flow diagram of a method of using the inventive combination of FIG. 23.

Flowchart 700 of FIG. 25 shows method steps of a process of using an inventive detachable sole (such as 500). The process commences at start step 702, and continues at process step 704. At process step 704, a toe of a ski boot (such as 558) is placed into a toe confinement portion (such as 530) of a sole portion (such as 506). At process step 706, a heel of the ski boot is placed in mating contact with the sole portion. At process step 708, a latch assembly (such as 502) is pulled to position a latch (such as 508), of the latch assembly into a confinement position adjacent the ski boot, and the process concludes at end process step 710.

Figures 26, 27, 28:
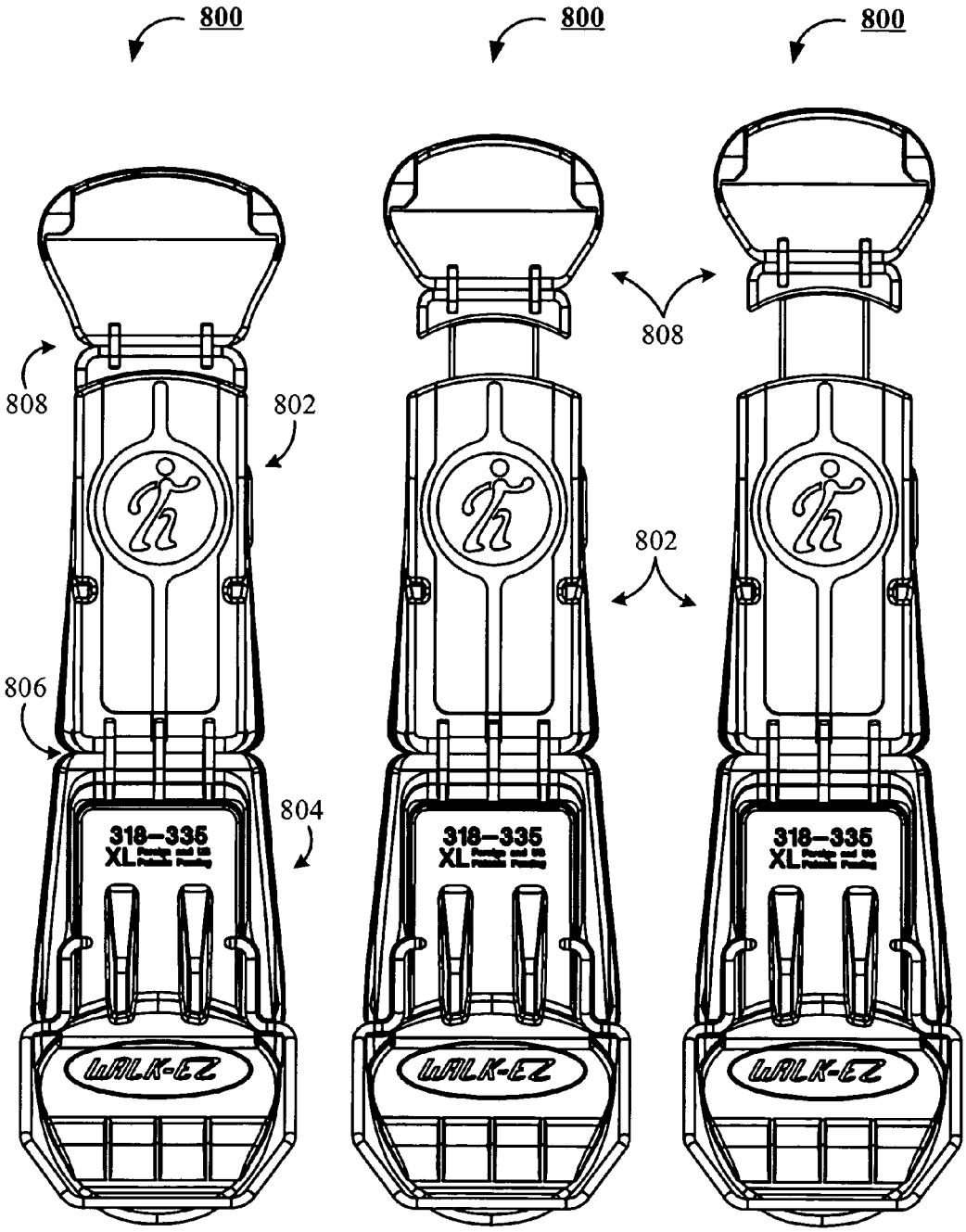
FIG. 26 illustrates a top plan view of an inventive ski boot attachment shown in a fully retracted position.
FIG. 27 is a top plan view of the inventive ski boot attachment of FIG. 26 shown in a partially extended position.
FIG. 28 is a top plan view of the inventive ski boot attachment of FIG. 26 shown in a fully extended position.

FIG. 26 shows an inventive ski boot attachment 800 that includes a main body portion 802, a heel portion 804 hinged to the main body portion by a main hinge assembly 806, and a toe portion 808, which is in sliding engagement with the main body portion 802. The toe portion 808 is in sliding engagement with the main body portion 802 to accommodate ski boots of various lengths. For example, ski boots of a size falling within the range of 318 mm to 335 mm can be accommodated by an embodiment of the present inventive ski boot attachment 800.

Continuing with the example of ski boots of a size falling within the range of 318 mm to 335 mm, FIG. 27 shows the toe portion 808 partially extended relative to the main body portion 802, which would accommodate a ski boot of a size of about 226 mm, while FIG. 28 shows the toe portion 808 in a fully extended position and configured to accommodate a ski boot of a length of about 335 mm.

Figure 29:
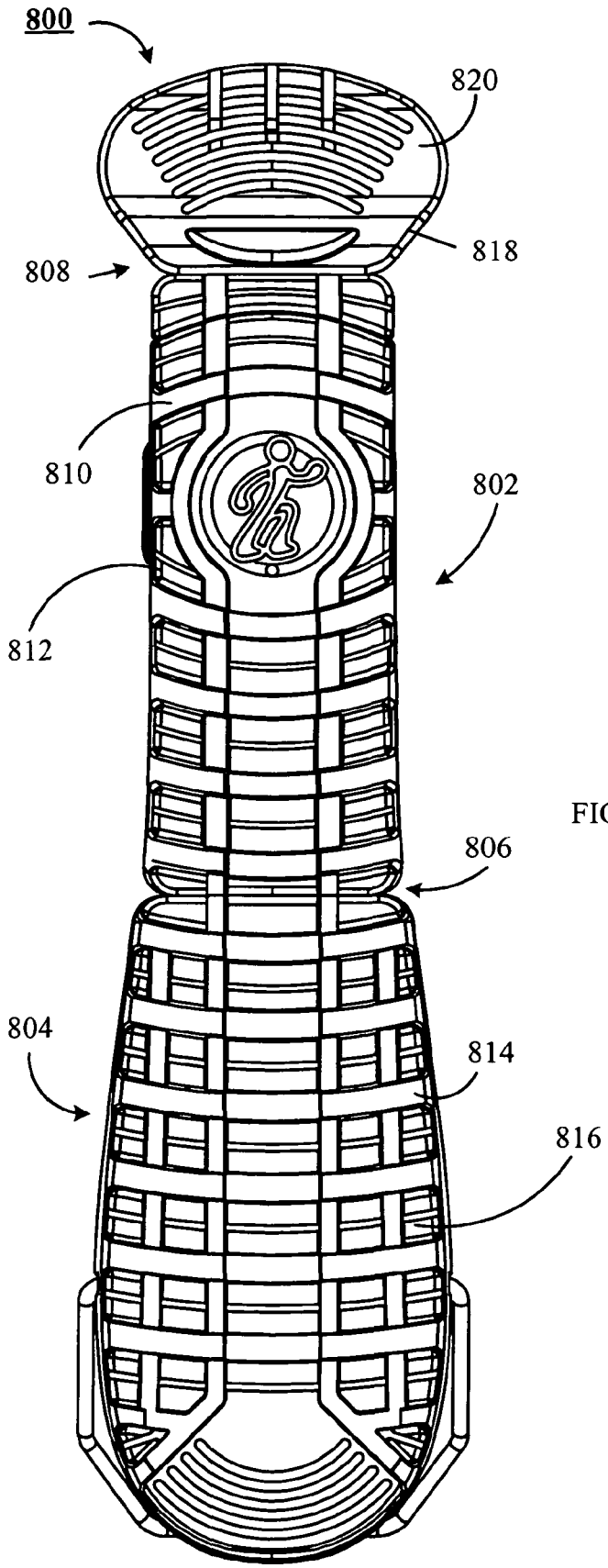
FIG. 29 is a bottom plan view of the inventive ski boot attachment of FIG. 26.

The bottom plan view of the inventive ski boot attachment 800 shown by FIG. 29 reveals that the main body portion 802 includes a main chassis 810 supporting a main tread 812, the heel portion 804 includes a heel chassis 814 supporting a heel tread 816, and the toe portion 808 includes a toe chassis 818 supporting a toe tread 820.

In a preferred embodiment, the main chassis 810, the heel chassis 814, and the toe chassis 818 are partially visible, when viewing the bottom of the inventive ski boot attachment 800. It is further noted that in a preferred embodiment, a polycarbonate type material (available in a variety of colors), may be selected for use in producing the main chassis 810, a heel chassis 814, and the toe chassis 818. It is understood by those skilled in the art that the identification of polycarbonate as a type of material useful in producing the main chassis 810, the heel chassis 814, and the toe chassis 818 does not impose any limitations on the present inventive ski boot attachment 800, and that other polymers, metals, and composite materials could be readily substituted for the preferred polycarbonate used in forming the main chassis 810, the heel chassis 814, and the toe chassis 818.

Figure 30:
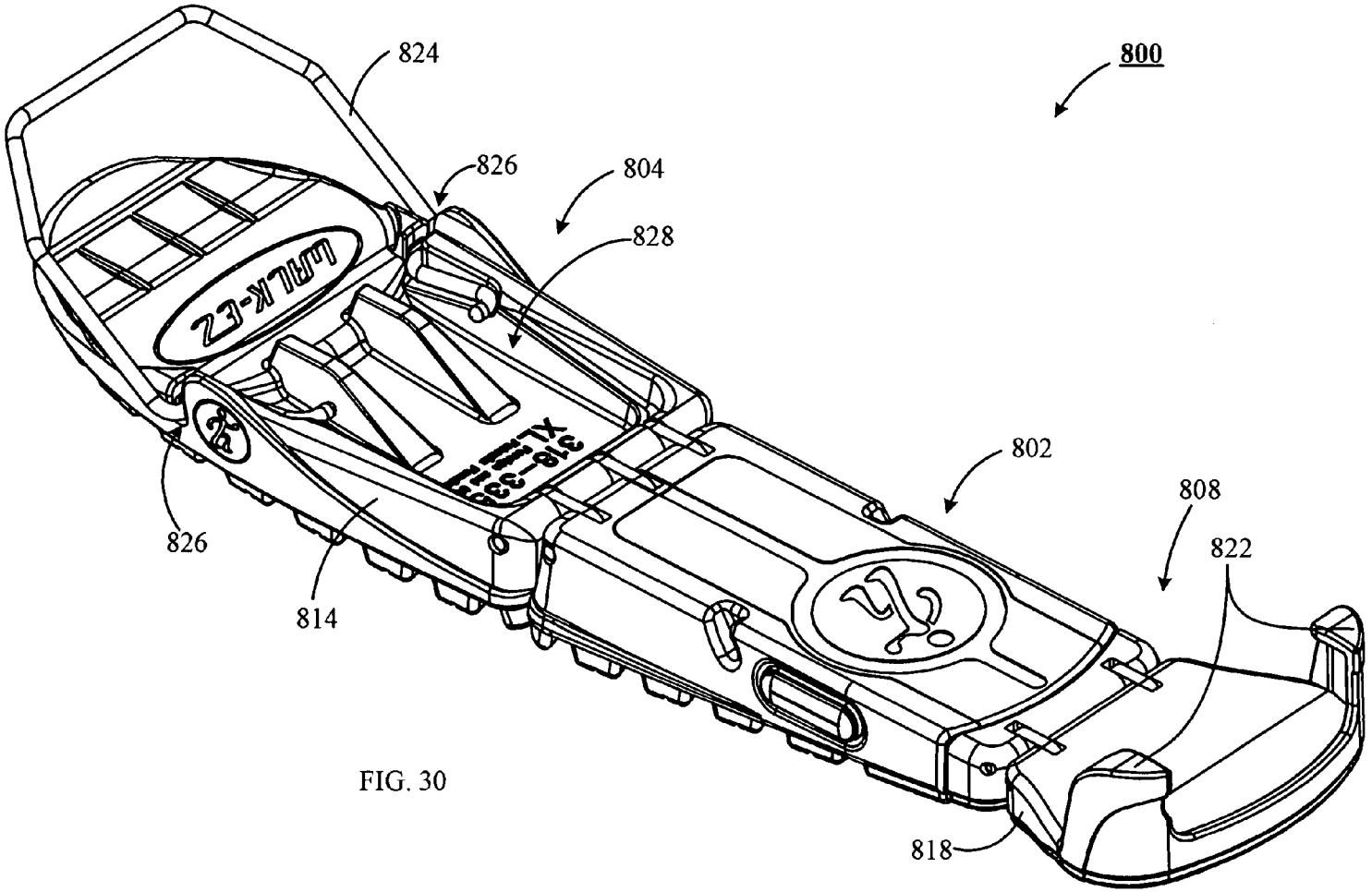
FIG. 30 is a top perspective view of the inventive ski boot attachment of FIG. 26.

FIG. 30 shows the toe portion 808 preferably provides a pair of toe reception features 822, and the heel portion 804 preferably provides a binding 824. In a preferred embodiment, the toe reception features 822 and the binding 824 cooperate to secure the inventive ski boot attachment 800 to a ski boot. Also in the preferred embodiment, the pair of toe reception features 822 are formed during the process of producing a toe chassis 818, and a pair of binding reception channels 826 are formed during the process of producing the heel chassis 804.

The preferred embodiment further includes a main body reception cavity 828 formed during the process of producing the heel chassis 814. The main body reception cavity 828 is preferably sized to partially accommodate the main body portion 802, when the inventive ski boot attachment 800 is in a fully folded configuration and ready for storage, as shown by FIG. 32.

Figure 31:
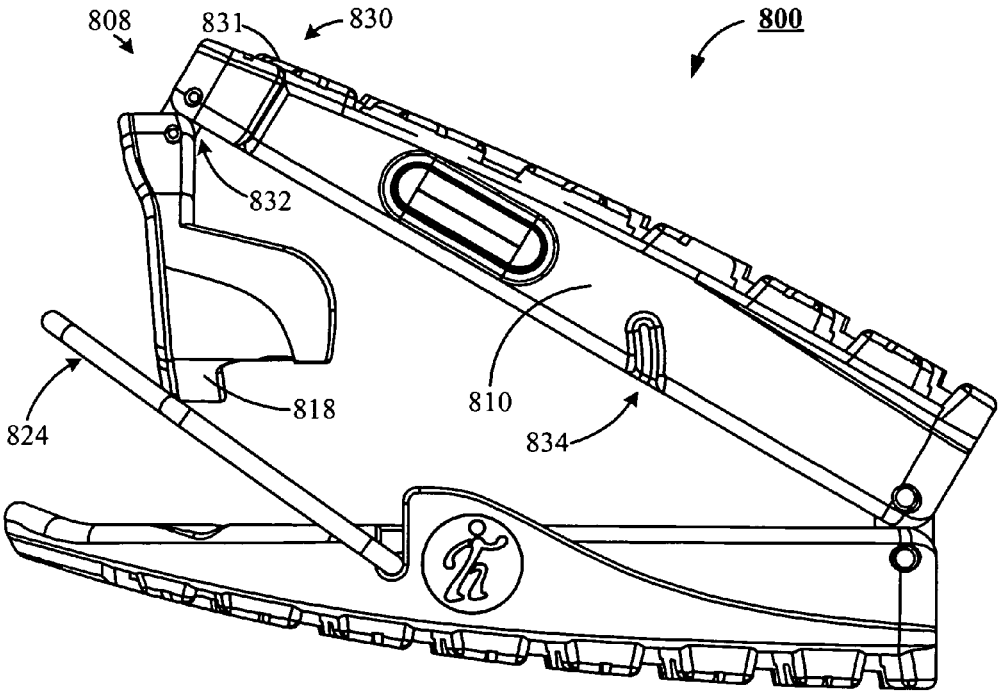
FIG. 31 is a side elevation view of the inventive ski boot attachment of FIG. 26 shown in a partially folded configuration.
Figure 32:
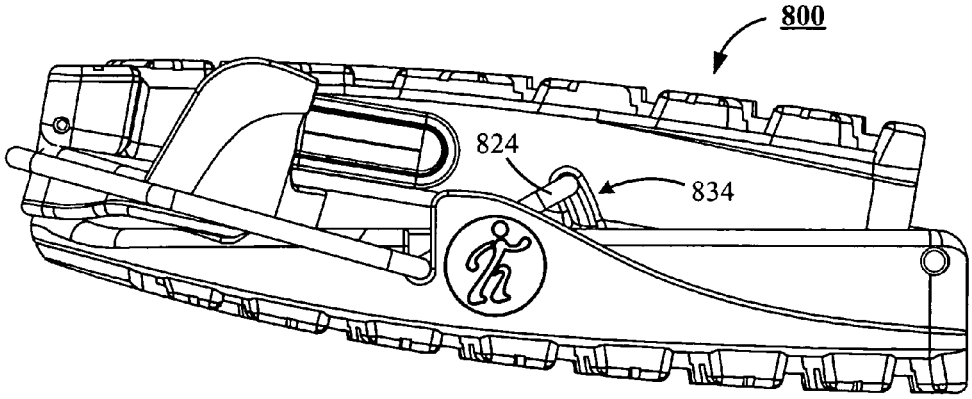
FIG. 32 is a side elevation view of the inventive ski boot attachment of FIG. 26 shown in a fully folded configuration, and ready for storage.

FIG. 31 shows the toe portion 808 includes the toe chassis 818 hinged to a slide member 830 by a toe hinge assembly 832, and the main chassis 810 provides a pair of binding guide channels 834 (only one shown), which accommodate reception of the binding 824 when the inventive ski boot attachment 800 is in a fully folded configuration as shown by FIG. 32. Preferably, the slide member 830 further includes a slide tread 831 secured to a bottom portion of the slide member 830.

Figure 33:
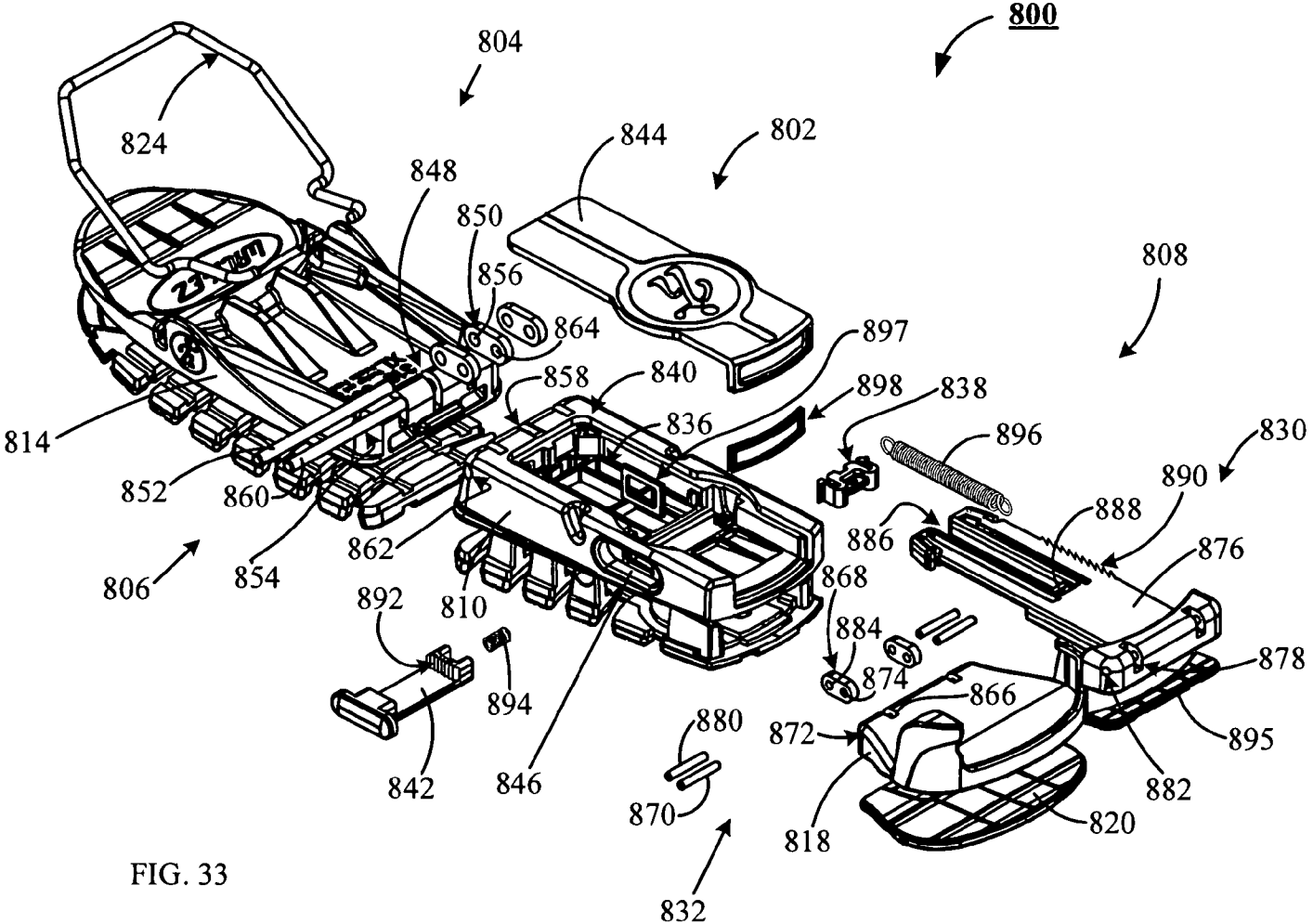
FIG. 33 is a top perspective exploded view of the inventive ski boot attachment of FIG. 26.

FIG. 33 shows the main chassis 810 preferably provides a component cavity 836, which houses a plurality of components found useful for the operation of the slide member 830. Among the components housed by the component cavity 836 are a spring mount 838, which is confined by a spring mount nesting feature 840 provided by the main chassis 810, an extension control member 842, and a component cavity cover 844. In a preferred embodiment, the extension control member 842 is positioned within the component cavity 836 through an extension controlled member aperture 846 provided by the main chassis 810.

FIG. 33 further shows the heel chassis 814 provides a main hinge plate reception cavity 848 for receipt of a main hinge plate 850 of the main hinge assembly 806. In a preferred embodiment, a first main hinge pin 852 is passed through a heel hinge pin attachment aperture 854 of the heel chassis 814 and a first hinge pin mounting aperture 856 of the main hinge plate 850 to secure the main hinge plate 850 to the heel chassis 814.

FIG. 33 also shows the main chassis 810 provides a corresponding main hinge plate reception cavity 858 for reception of the main hinge plate 850. Preferably, a second main hinge pin 860 is passed through a hinge pin attachment aperture 862 of the main chassis 810 and a second hinge pin mounting aperture 864 of the main hinge plate 850 to secure the first main hinge plate 852 to the main chassis 810, thereby forming a hinged connection between the main chassis 810 and the heel chassis 814.

Continuing with FIG. 33, the toe chassis 818 provides a toe hinge plate reception cavity 866 for receipt of a toe hinge plate 868 of the toe hinge assembly 832. In a preferred embodiment, a first toe hinge pin 870 is passed through a toe hinge pin attachment aperture 872 of the toe chassis 818 and a first hinge pin mounting aperture 874 of the toe hinge plate 868 to secure the toe hinge plate 868 to the toe chassis 818.

To form a hinged connection between the toe chassis 818 and the slide member 830, the slide member 830 preferably includes a slide chassis 876. Preferably, the slide chassis 876 provides a toe hinge plate reception cavity 878 that corresponds to the toe hinge plate reception cavity 866 provided by the toe chassis 818 and which serves to receive the toe hinge plate 868. Preferably, a second hinge pin 880 is passed through a hinge pin attachment aperture 882 of the slide chassis 876 and a second hinge pin mounting aperture 884 of the toe hinge plate 868 to secure the toe hinge plate 868 to the slide chassis 876, thereby forming a hinged connection between the toe chassis 818 and the slide chassis 876.

In a preferred embodiment, the slide member 830 serves to regulate an overall length of the inventive ski boot attachment 800. To accommodate this length regulation function of the preferred embodiment, the slide chassis 876 provides a spring channel 886, a spring stay 888 disposed within and attached to the slide chassis 876, and a plurality of extension control teeth 890. The extension control teeth 890 interact with extension engagement teeth 892 of the extension control member 842 to maintain the extension of the toe portion 808 at a predetermined distance from the main body portion 802. Preferably, a release spring 894 applies pressure to a back side of the extension control member 842 to maintain engagement of the extension engagement teeth 892 with extension control teeth 890 until a compressive force is applied to the extension control member 842 to compress the release spring 894.

Preferably, the spring channel 886 accommodates a main spring 896, which is disposed between an attached to each the spring stay 888 and the spring mount 838. During operation of the inventive ski boot attachment 800, the main spring 896 imparts a tension spring force between the slide chassis 876 in the main chassis 8 10 that encourages the slide chassis 876 into abutment with the main chassis 8 10. In practicing a preferred embodiment of the present inventive ski boot attachment 800, the extension control teeth 890 slip past the extension engagement teeth 892 when the toe portion 808 is being extended from the main body portion 802.

When a predetermined length has been reached, the extension control teeth 890 interact with the extension engagement teeth 892 to counteract the tension spring force exerted by the main spring 896. When the release spring 894 is compressed by the mutilation of the extension control member 842 (i.e., pressure is applied to the extension control member 842), the extension engagement teeth 892 are placed into a position of disengagement with the extension control teeth 890, and the main spring 896 pulls the toe portion 808 into abutting contact with the main body portion 802.

In a preferred embodiment, an extension control member seal 897 and a slide seal 898 (each preferably formed from a resilient material such as polypropylene, urethane, latex, butyl rubber, or other suitable resilient materials), are used to mitigate passage of debris into the component cavity 836.

Figure 34:
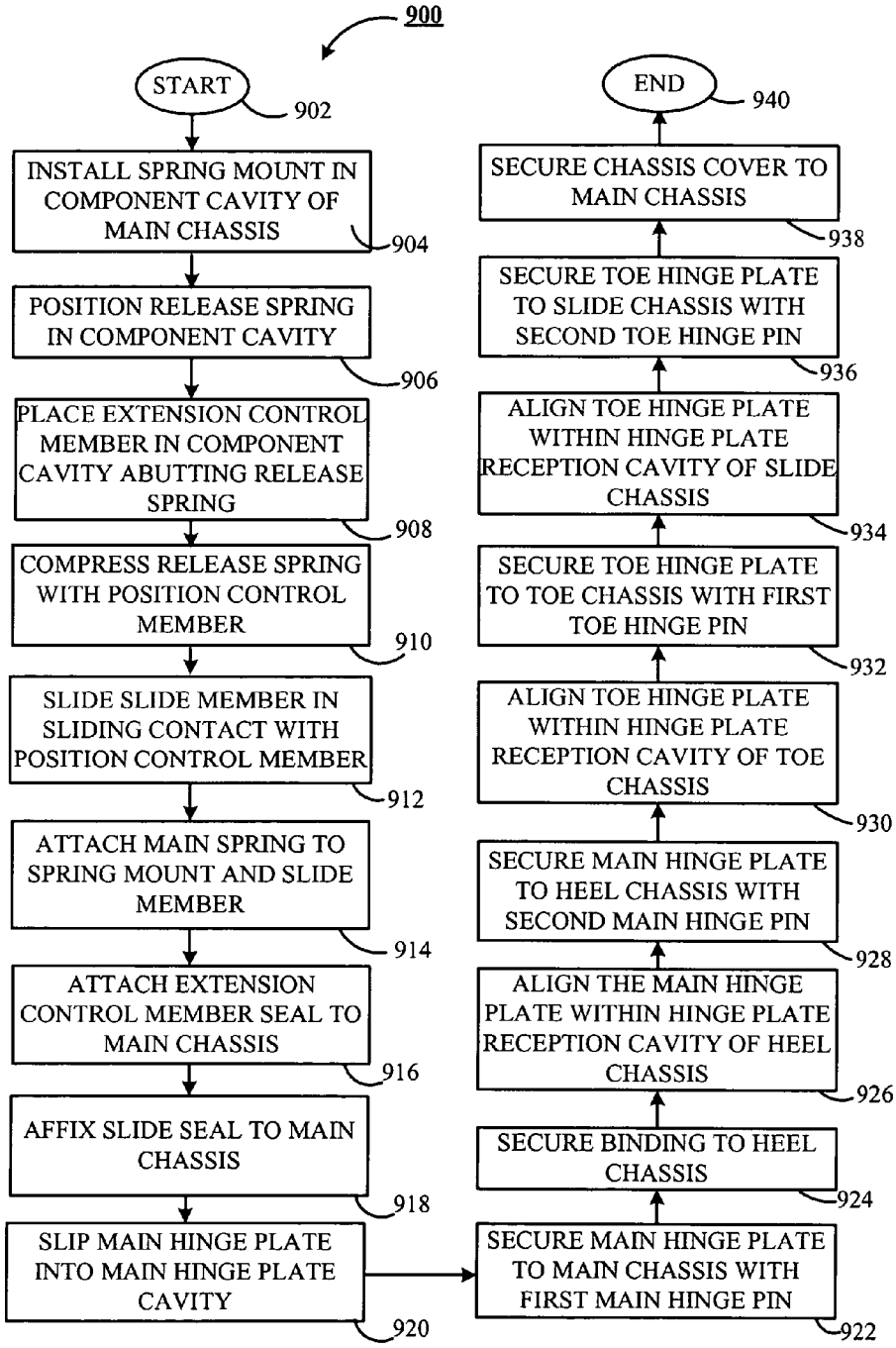
FIG. 34 is a flow diagram of a method of assembling the inventive ski boot attachment of FIG. 26.

Flowchart 900 of FIG. 34 shows method steps of a process of making an inventive ski boot attachment (such as 800). The process commences at start process step 902, and continues at process step 904. At process step 904, a spring mount (such as 838) is installed within a spring mount nesting feature (such as 840) provided by a main chassis (such as 810). At process step 906, a release spring (such as 894) is positioned within a component cavity (such as 836), and at process step 908, an extension control member (such as 842) is placed within the component cavity in abutting contact with release spring.

At process step 910, compression of the release spring is attained by applying pressure to the extension control member. At process step 912, a slide member (such as 830) is slid into sliding contact with the extension control member. At process step 914, a main spring (such as 896) is attached to each the spring mount and a spring stay (such as 888), which is confined within a slide chassis (such as 876). At process step 916, an extension control member seal (such as 897) is attached to the main chassis. At process step 918, a slide seal (such as 898) is affixed to the main chassis, and at process step 920, a main hinge plate (such as 850) is slipped into a main hinge plate cavity (such as 858) of the main chassis.

At process step 922, the main hinge plate is secured to the main chassis using a first main hinge pin (such as 852). At process step 924, a binding (such as 824) is secured to a heel chassis (such as 814). At process step 926, the main hinge plate is aligned with a hinge plate reception cavity (such as 848) of the heel chassis for securement of the main hinge plate to the heel chassis, which occurs through use of a second main hinge pin (such as 860) at process step 928.

At process step 930, a toe hinge plate (such as 868) is aligned within a toe hinge reception cavity (such as 866) of a toe chassis (such as 818), and at process step 932, the toe hinge plate is secured to the toe chassis through use of a first toe hinge pin (such as 870). Following alignment of the toe hinge plate within a hinge plate reception cavity (such as 878) of the slide chassis, at process step 934, the toe hinge plate is secured to the slide chassis through use of a second toe hinge pin (such as 880) at process step 936. At process step 938, a component cavity cover (such as 844) is secured to the main chassis, and the process concludes at end process step 940.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

It will be clear that the present invention is well adapted to attain the ends and advantages mentioned as well as those inherent therein. While presently preferred embodiments have been described for purposes of this disclosure, numerous changes may be made which will readily suggest themselves to those skilled in the art and which are encompassed by the appended claims.

What is claimed is:

1. A method of assembling a ski boot attachment by steps comprising:

installing a spring mount within a component cavity of a main chassis of said ski boot attachment;

positioning a release spring within the component cavity;

placing an extension control member within the component cavity in abutting contact with the release spring;

compressing the release spring with the extension control member;

sliding a slide member into the component cavity into sliding contact with the extension control member;

attaching a main spring to the spring mount and the slide member; and securing a chassis cover to the main chassis, wherein said ski boot attachment includes at least a main body portion formed by said main chassis providing said component cavity with said spring mount installed therein, said extension control member in sliding communication with said main chassis and nested within said component cavity, a component cavity cover enclosing the component cavity, and a main tread attached to a bottom portion of the main chassis.

2. The method of claim 1, by steps further comprising:

attaching an extension control member seal to the main chassis prior to placing the extension control member within the component cavity; and affixing a slide seal to the main chassis prior to sliding the slide member into the component cavity.

3. The method of claim 2, by steps further comprising:

slipping a main hinge plate into a main hinge plate reception cavity of the main chassis; and passing a first main hinge pin through a hinge pin attachment aperture of the main chassis and a first hinge and mounting aperture of the hinge plate to secure the main hinge plate to the main chassis.

4. The method of claim 3, by steps further comprising:

securing a binding to a heel chassis;

aligning the main hinge plate within a heel hinge plate reception cavity of the heel chassis; and passing a second main hinge pin through a heel hinge pin attachment aperture and a second hinge pin mounting aperture of the main heel plate to secure the main heel plate to the heel chassis.

5. The method of claim 4, by steps further comprising:

placing a toe hinge plate into a toe hinge plate reception cavity of a toe chassis; and passing a first toe hinge pin through a toe hinge pin attachment aperture of the toe chassis and a first hinge pin mounting aperture of the toe hinge plate to secure the toe hinge plate to the toe chassis.

6. The method of claim 5, by steps further comprising:

aligning the toe hinge plate within a toe hinge plate reception cavity of the slide member; and passing a second toe hinge pin through a toe hinge pin attachment aperture of the slide member and a second hinge pin mounting aperture of the toe hinge plate to secure the toe hinge plate to the slide member.

* * * * *